US008016285B2

(12) United States Patent
Horiuchi et al.

(10) Patent No.: US 8,016,285 B2
(45) Date of Patent: Sep. 13, 2011

(54) SHEET PACKAGE AND PRINTING UNIT

(75) Inventors: Takashi Horiuchi, Kariya (JP); Yasunori Nakamura, Shinshiro (JP); Yoshikatsu Suito, Kitanagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 373 days.

(21) Appl. No.: 12/011,176

(22) Filed: Jan. 24, 2008

(65) Prior Publication Data

US 2008/0187386 A1 Aug. 7, 2008

(30) Foreign Application Priority Data

Jan. 26, 2007 (JP) ..... 2007-016933

(51) Int. Cl.
*B65H 1/00* (2006.01)

(52) U.S. Cl. ..... 271/145

(58) Field of Classification Search ..... 271/145; 206/449, 451, 454, 455
See application file for complete search history.

(56) References Cited

U.S. PATENT DOCUMENTS

| | | | | |
|---|---|---|---|---|
| 3,727,823 | A * | 4/1973 | Sullivan | 206/449 |
| 4,185,745 | A * | 1/1980 | Moser et al. | 206/556 |
| 6,217,019 | B1 * | 4/2001 | Ishiduka et al. | 271/147 |
| 6,546,210 | B1 * | 4/2003 | Nakamura | 399/12 |
| 2002/0056961 | A1 * | 5/2002 | Sasaki et al. | 271/145 |
| 2005/0230902 | A1 | 10/2005 | Sugiyama et al. | |
| 2006/0012110 | A1 * | 1/2006 | Yamamoto et al. | 271/145 |

FOREIGN PATENT DOCUMENTS

| | | | |
|---|---|---|---|
| EP | 1312554 | A1 | 5/2003 |
| EP | 1795468 | A2 | 6/2007 |
| EP | 1932675 | A1 | 6/2008 |
| JP | S59-183810 | U | 12/1984 |
| JP | 11292310 | | 10/1999 |
| JP | 2002-274667 | A | 9/2002 |
| JP | 2003176041 | | 6/2003 |
| JP | 2003285939 | | 10/2003 |
| JP | 2004-210433 | A | 7/2004 |

* cited by examiner

*Primary Examiner* — Stefanos Karmis
*Assistant Examiner* — Ernesto Suarez
(74) *Attorney, Agent, or Firm* — Day Pitney LLP

(57) ABSTRACT

In a sheet package, the degree of stiffness of a side end portion on a side wall portion side making contact with a contact member in a storage portion of a printing unit is greater than the degree of stiffness of a side end portion on the side wall portion side that is pressed by a pressing guide member. Accordingly, when the sheet package is stored in the storage portion, even if the lid body is closed in a condition in which the sheet package is not loaded properly, that is, even if the side end portion of the sheet package is sandwiched between the lid body and the contact member, or a top face on the side on which the contact member is provided, the sheet package is never crushed and the sheet package can be correctly pushed into the storage portion by a pressing force of the lid body.

13 Claims, 27 Drawing Sheets

SHEET PACKAGE AND PRINTING UNIT

The present application claims priority from Japanese Patent Application No. 2007-16933, which was filed on Jan. 26, 2007, the disclosure of which is herein incorporated by reference in its entry.

BACKGROUND

The present disclosure relates to a sheet package, and more particularly to a sheet package which protects with a package material the outside of stacked sheets and which sheet package can be set in a printing unit together with the package material; and to a printing unit to/from which the sheet package can be attached/detached.

In a conventionally known box-shaped package material, stacked sheets are stored. When the sheets are used for printing, by opening the lid of the package material, and by folding the lid back to the opposite side, the sheets are set in the printing unit together with the package material (see, for example, Japanese Patent Application Laid-Open No. 2003-285939). Ease of use of this sheet package is enhanced because a plurality of sheets can be handled as a package unit. Further, because the sheets on the inside are covered and thus protected, effectiveness has proved possible when heat sensitive papers weak to light or heat are stored as the sheets. Further, there has been known a printing unit in which the sheet package is loaded with sheets stored in a stacked condition and partially exposed from the sheet package, and in which printing unit sheets are pulled out from the sheet package and printed (see, for example, Japanese Patent Application Laid-Open No. 2003-176041). This kind of printing unit is provided with a contact portion with which one side end of the sheet package makes contact in a sheet package storage portion, and a sheet package-pressing means for pressing the other side end portion of the sheet package is provided on a side face on the opposite side of the storage portion, so that the one side end portion of the sheet package is pressed against the contact portion provided in the storage portion by means of pressing of the sheet package-pressing means.

However, according to the conventional sheet package described in the Japanese Patent Application Laid-Open No. 2003-176041, if the lid of the storage portion is closed in a condition in which the sheet package has not been properly loaded at the time that the sheet package was stored in the storage portion, a side end portion of the sheet package has sometimes tended to be caught between the lid and an outside portion of the storage portion on the side provided with the contact portion. In such cases, if the side end portion of the sheet package does not have sufficient strength, the sheet package is simply crushed, and the sheet package is accordingly not pushed into the storage portion by the pressing force of the lid.

If the kind of situation described above does occurs, even when sufficient sheets are stored, a sheet sensor cannot detect any sheet, and in consequence, despite the fact that sufficient sheets are stored the sensor tends to determine that all sheets have been used up, thereby making it impossible for printing to take place.

SUMMARY

The present disclosure has been achieved to solve the above described problem, and an object of the disclosure is to provide a sheet package in which the sheet package can be satisfactorily pushed into the storage portion properly by a pressing force of the lid, and a printing unit therefore.

To solve the above described problem, according to a first aspect of the present disclosure, there is provided a sheet package for use in a printing unit having a storage portion in which the sheet package is stored detachably in such a way that part of the sheets are exposed outside the sheet package in which are stored the stacked sheets; a printing portion that prints a sheet discharged from the sheet package; a contact portion with which an end portion on one of the two ends of the sheet package in a width direction of the sheet that is perpendicular to the direction of a sheet discharged from the sheet package makes contact in the storage portion; a pressing portion that presses an end portion on the other side that is different from the end portion on the one of the two ends in such a way as to press the end portion of the one side of the sheet package against the contact portion; and a lid supported in such a way that it is capable of being opened/closed as it covers the storage portion, wherein a degree of stiffness of the end portion on the one side that is brought into contact with the contact portion is greater than a degree of stiffness of the end portion on the other side that is pressed by the pressing portion.

According to a second aspect of the present disclosure, there is provided a printing unit onto which the sheet package can be loaded detachably, wherein a pickup roller that feeds a sheet from the sheet package is provided in the storage portion and by the lid being closed, the sheet package is pressed by part of the lid, and an exposed portion of the sheet is accordingly pressed against the pickup roller.

BRIEF DESCRIPTION OF THE DRAWINGS

Exemplary embodiments will be described in detail with reference to the accompanying drawings in which.

DESCRIPTION OF THE PREFERRED EMBODIMENTS

Figure 1:
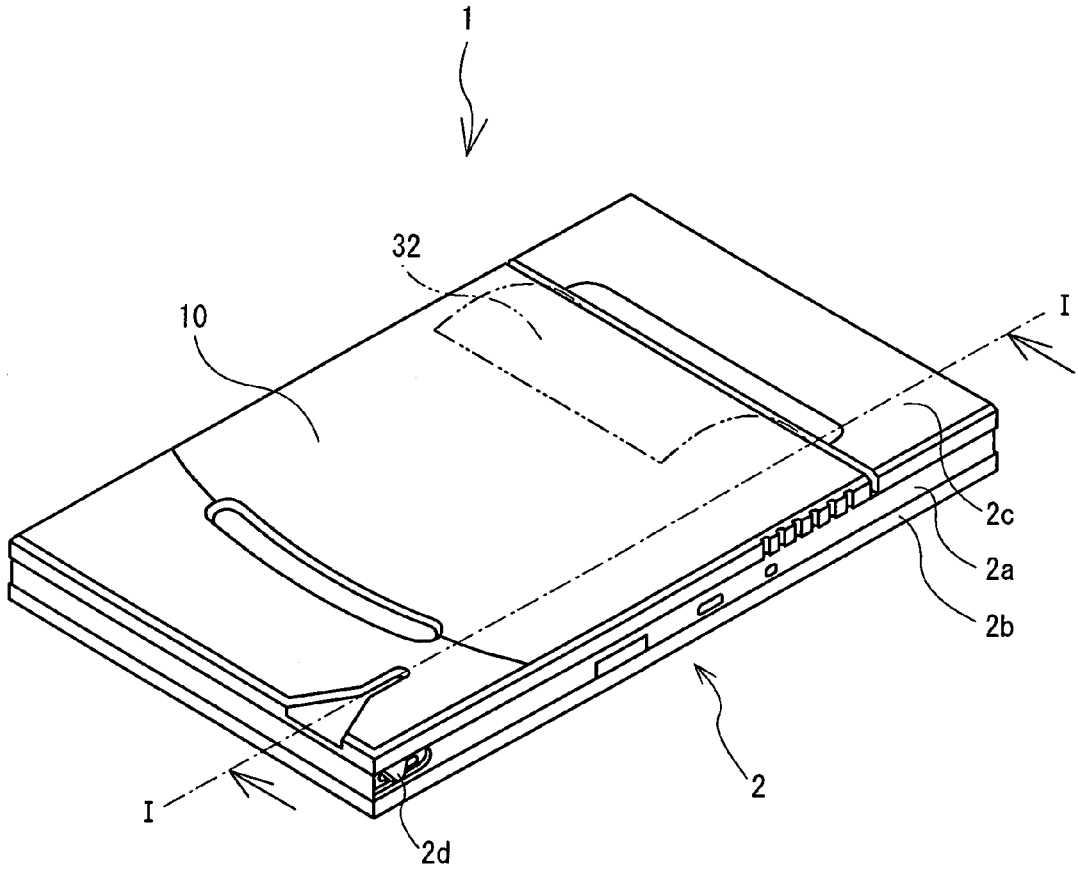
FIG. 1 is a perspective view of a printing unit.

Hereinafter, the structure of the printing unit of the first embodiment of the present disclosure, a printing unit onto which a sheet package 30 is loaded, will be described with reference to FIGS. 1-7.

As shown in FIGS. 1-3 and FIGS. 5-7, the printing unit 1 is rectangular in its plan view (of a size that is slightly larger than A5 size), and is formed into a flat rectangular parallelepiped configuration having a thickness of about 2 cm. The main body case 2 which constitutes the casing of the printing unit 1 is constituted of a frame body 2*a*, a lower cover 2*b*, an upper cover 2*c*, a lid body 10 and the like. The frame body 2*a* constitutes a frame of the printing unit 1, and forms a rectangular shape as seen in its plan view. The lower cover 2*b* covers the bottom face of the frame body 2*a*, thereby forming a rectangular shape as seen in its plan view. The upper cover 2*c* covers part of the top face of the frame body 2*a*. The lid body 10 can be opened/closed.

The substantially rectangular upper cover 2*c* occupying about one quarter of the main body top surface is formed on the top surface of the main body case 2 proximate to an end along the short direction of the main body case 2. A storage portion 5 in which a sheet package 30 is stored is formed in a portion that excludes the upper cover 2*c*. A printing mechanism portion 14, which will be described later, is provided inside the main body case 2, which is covered by the upper cover 2*c*. The lid body 10 is provided so as to cover the storage portion 5.

Figure 2:
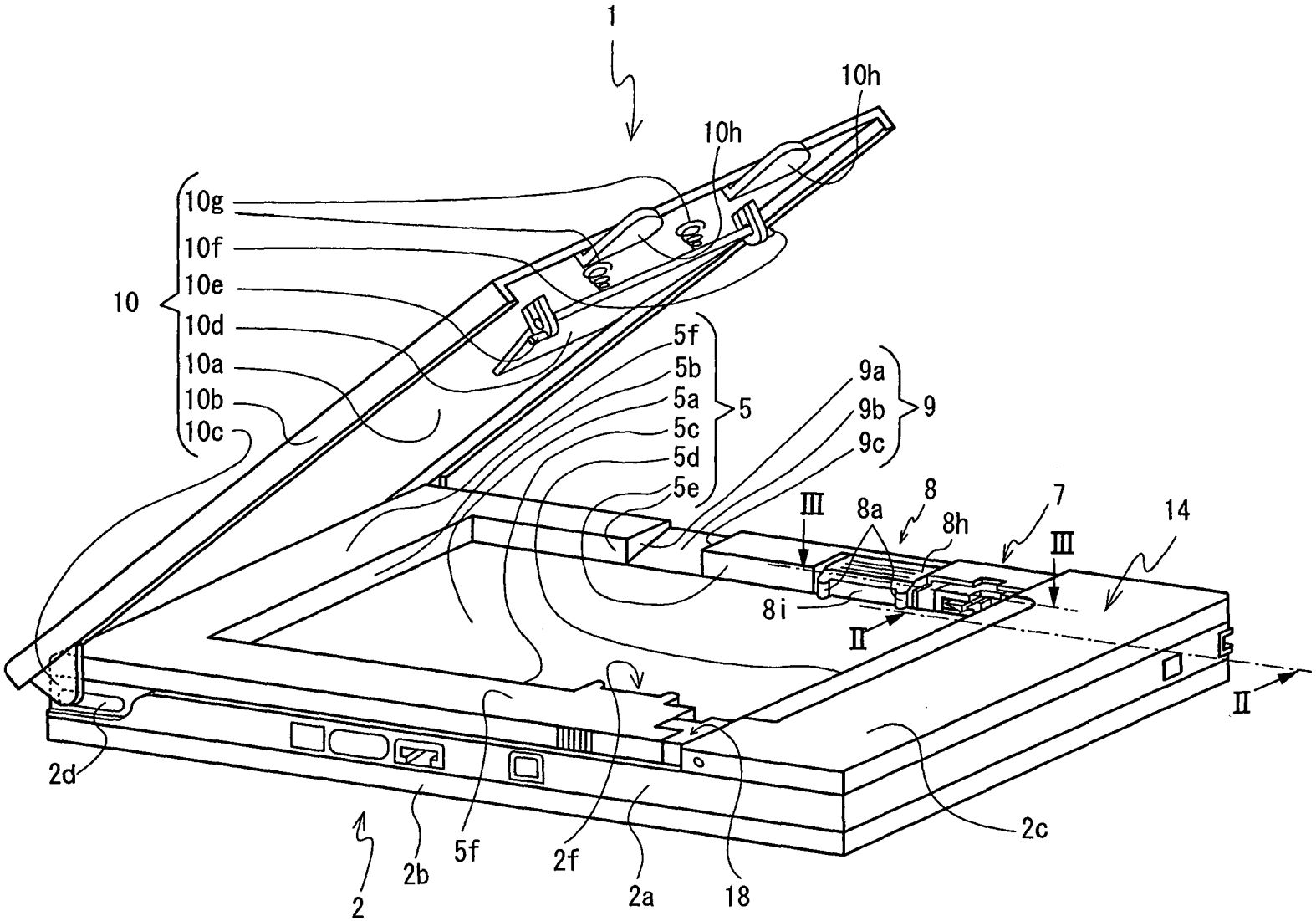
FIG. 2 is a perspective view showing an appearance of a state in which the lid of the printing unit is opened.
Figure 3:
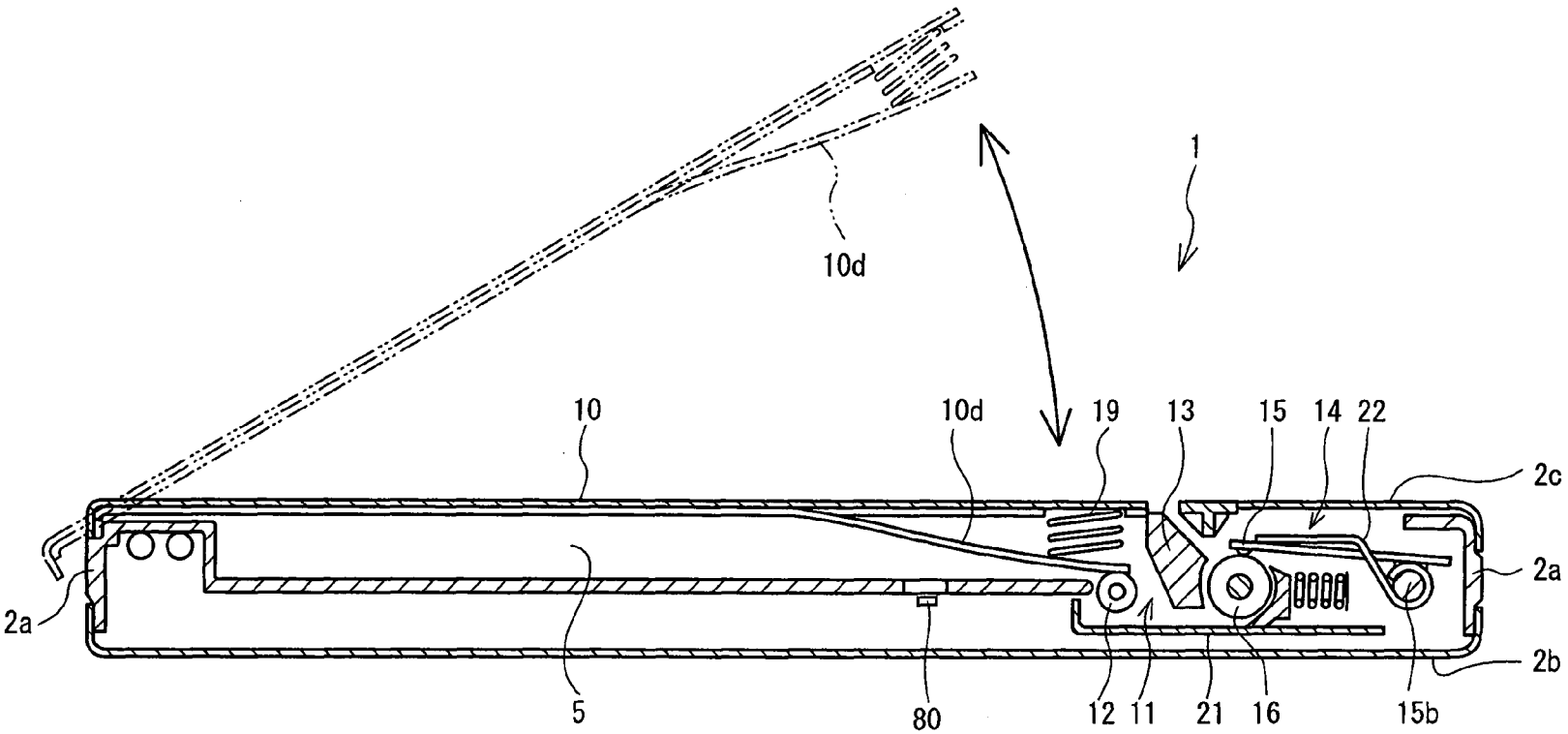
FIG. 3 is a sectional view in an arrow direction of the printing unit, taken along the line I-I in FIG. 1.

As shown in FIG. 2 and FIG. 3, the lid body 10 is formed of a lid body top face 10*a*, a lid body side face 10*b*, an opening/closing shaft 10*c*, a pressing plate 10*d*, lock pieces 10*e* and 10*f* and an urging spring 10*g*. The lid body top face 10*a* is of a size that covers the storage portion 5 and is of a substantially rectangular shape. The lid body side faces 10*b* are provided on both side faces in a longitudinal direction of the lid body top face 10*a*. The opening/closing shaft 10*c* is provided at an end portion of the lid body side face 10*b*. The pressing plate 10*d*, the urging spring 10*g* and the lock pieces 10*e* and 10*f* are provided in a concave portion surrounded by the lid body top face 10*a* and the lid body side faces 10*b* and proximate to a free end with respect to a fixed end provided with the opening/closing shaft 10*c*. Further, a slide groove 2*d* is provided at an end portion (left side in FIG. 2) of each of the outer side faces in the longitudinal direction of the main body case 2. The lid body 10 is engaged with the rear end portion (the leftward direction in FIG. 2, and is referred to as the "rear" for convenience of description) of the frame body 2*a* of the main body case 2. The lid body 10 is opened/closed by this engagement portion that serves as a rotation shaft. Further, when the lid body 10 is opened, the lid body 10 is made to slide in a direction of departing from the upper cover 2*c* (in the leftward direction in FIG. 2) but only to an extent that corresponds to the length of the slide groove 2*d*. In this manner the lid body 10 is opened with the opening/closing shaft 10*c* serving as a rotation shaft.

Figure 6:
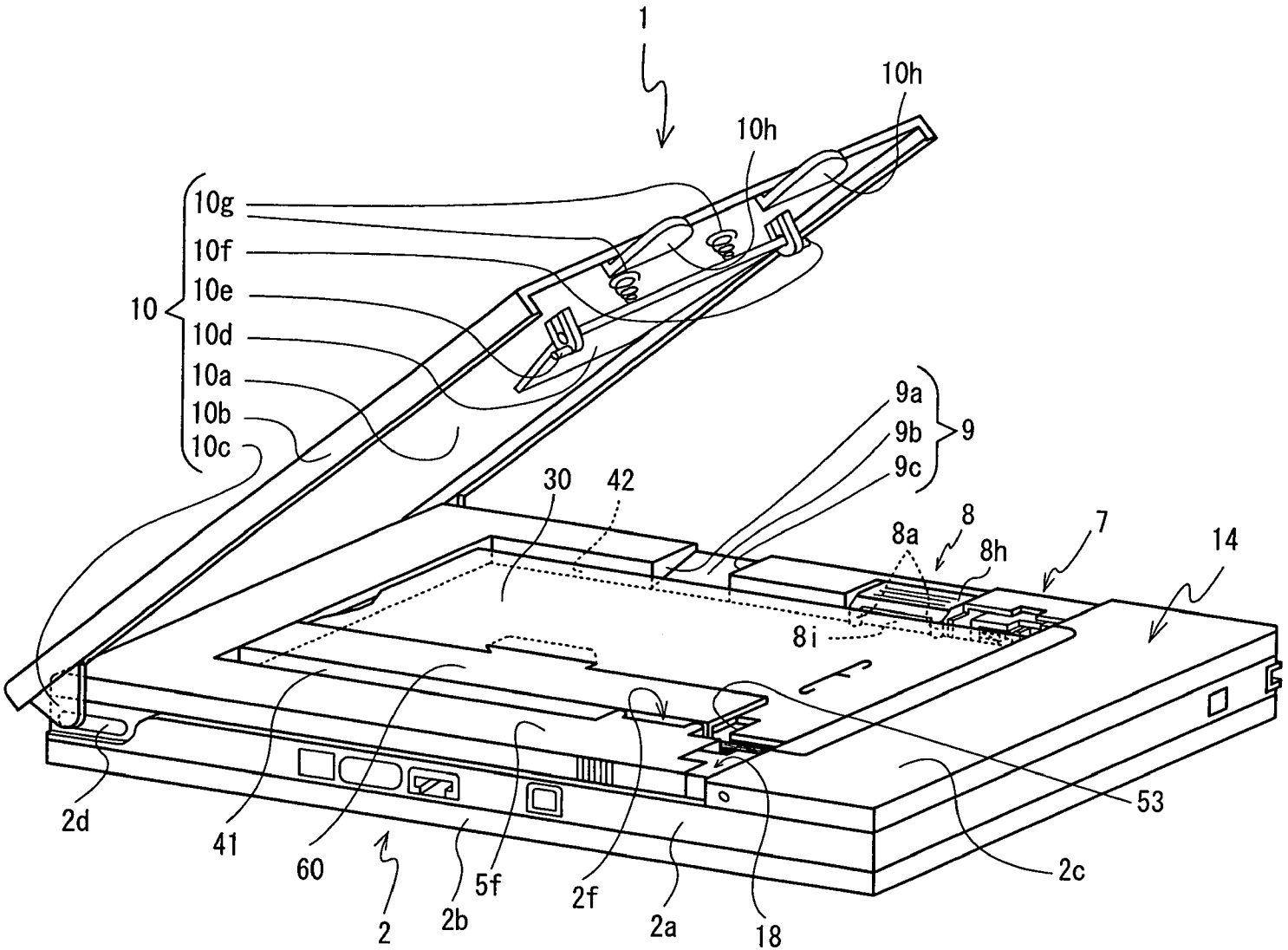
FIG. 6 is a perspective view of a state in which the sheet package is loaded.

As shown in FIG. 2 and FIG. 6, the storage portion 5 is formed of a top face portion 5*f*, a bottom face portion 5*a* and side face portions 5*b*, 5*c*, 5*d*, and 5*e*. The top face portion 5*f* is provided at a position that is lower than the top cover 2*c* to an extent that corresponds to the thickness of the lid body 10 in a portion that excludes the top cover 2*c* of the top surface of the main body case 2. The top face portion 5*f* forms a square frame as seen in a plan view that is lacking a side on the top cover 2*c* side. A concave portion is formed in the central portion of the top face portion 5*f*. The bottom face of the concave portion is formed of the bottom face portion 5*a* and the side faces of the same concave portion are formed by surrounding the four sides of the bottom face portion 5*a* with side face portions 5*b*, 5*c*, 5*d*, and 5*e*. Further, the bottom face portion 5*a* stores a sheet package 30 of substantially A6 size, as shown in FIG. 4.

Figure 5:
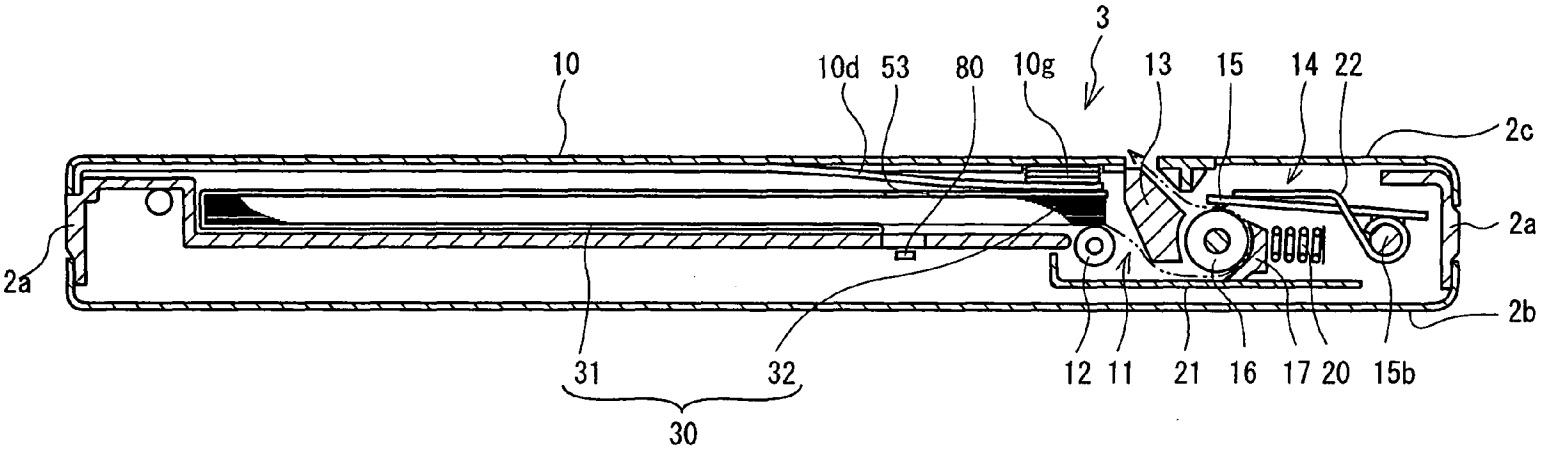
FIG. 5 is a sectional view in an arrow direction of a state in which the sheet package is set in the storage portion of the printing unit, taken along the line I-I in FIG. 1.

The printing mechanism portion 14 is incorporated inside an end portion (on the right side in FIG. 3 and FIG. 5) of the printing unit 1, as shown in FIG. 2, FIG. 3 and FIG. 5. The top cover 2*c* that is rectangular in its plan view is provided in such a way as to cover the top face of the printing mechanism portion 14. The storage portion 5 is formed in a residual portion of the top face of the frame body 2*a*, a portion that excludes the portion covered by the top cover 2*c*, and a portion above the storage portion 5 is covered with a lid body 10 that is rectangular in its plan view. This lid body 10 can be freely opened/closed as shown in FIG. 2 and FIG. 3.

Figure 4:
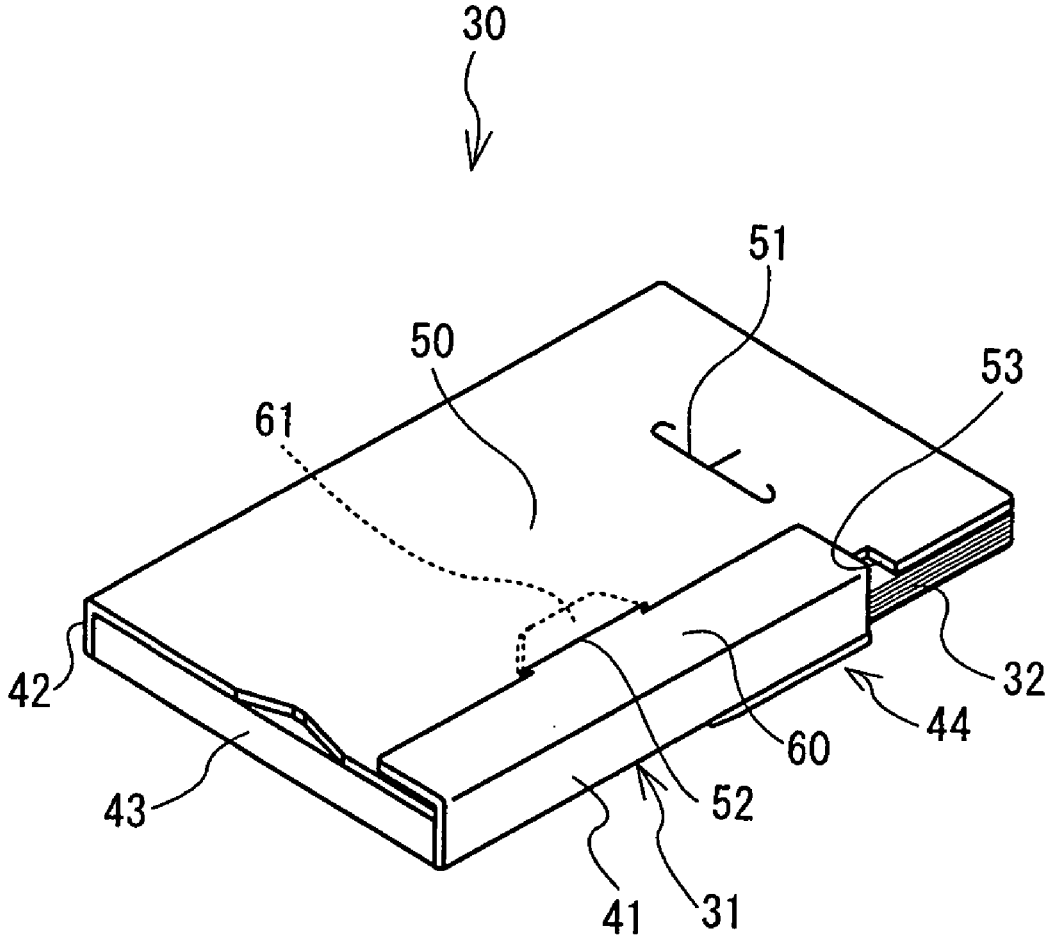
FIG. 4 is a perspective view of a sheet package with the lid portion folded back to its rear side.

As shown in FIGS. 4-6, the sheet package 30 storing a plurality of sheets 32 constituted of A6 size cut-sheet type heat sensitive papers within the package material can be stored in this storage portion 5.

Such as a pickup roller 12 and a separation block 13 are disposed as a sheet-separating portion 11 at an end portion on the printing mechanism portion 14 side of the storage portion 5. A thermal head 15 that serves as the printing mechanism portion 14, a platen roller 16, which is supported rotatably by a roller shaft 16*a* and a paper guide 17 are all disposed below the upper cover 2*c*.

A locking portion 18 and an interlocking portion 7 are provided in the vicinity of an end portion on the top cover 2*c* side of an edge portion constituted of side face portions 5*c* and 5*e* in a longitudinal direction and of the top face portion 5*f* of the concave portion of the storage portion shown in FIG. 2. When the lid body 10 is closed, the locking portion 18 and the interlocking portion 7 engage the lock pieces 10*e* and 10*f* of the lid body 10. Consequently, a lid body 10 that is once closed by the interlocking portion 7, which will be described later, is prevented from opening easily.

Figure 7:
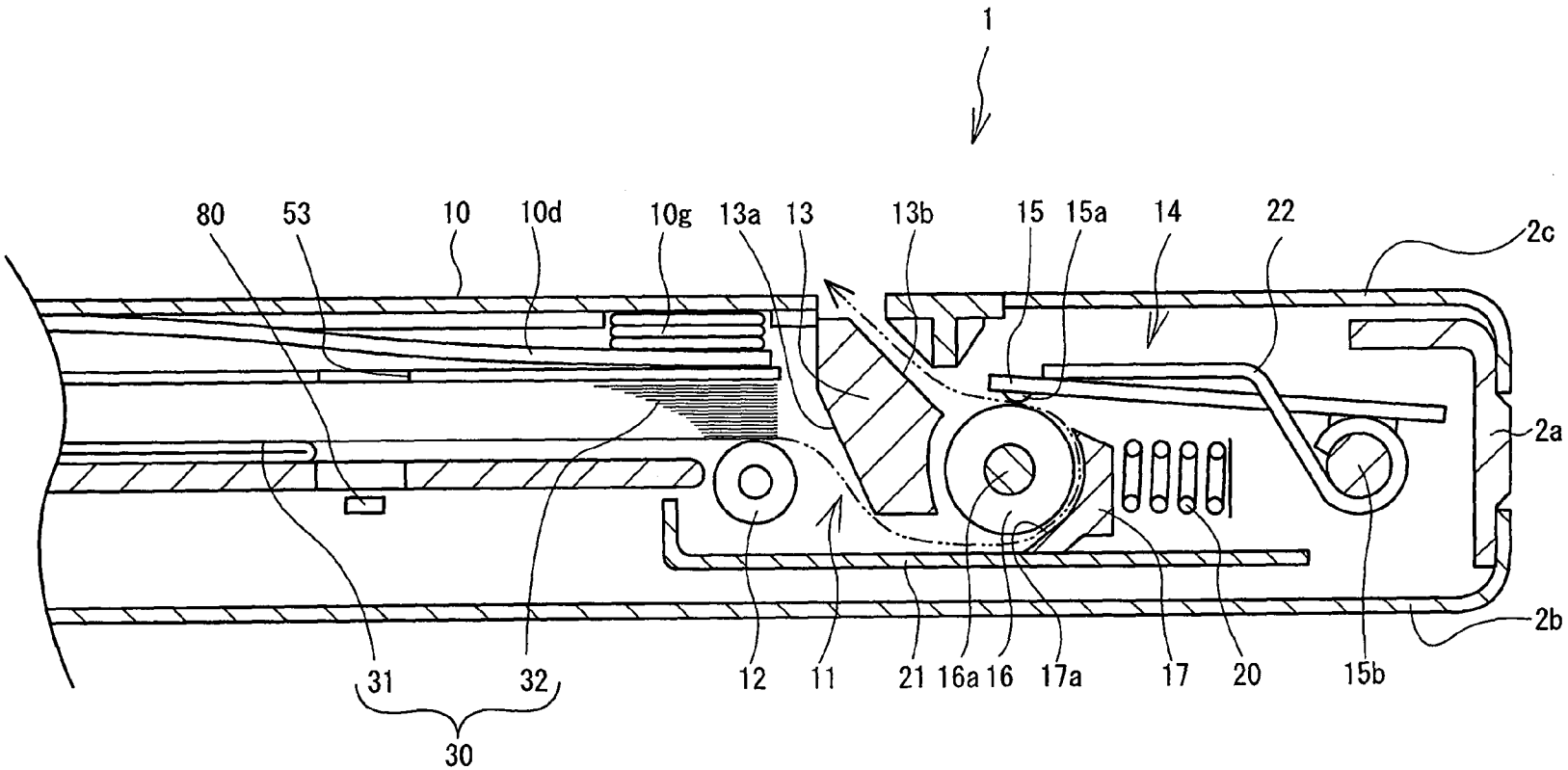
FIG. 7 is an enlarged sectional view showing the details of a paper separating portion and a printing mechanism portion.

Next, the sheet-separating portion 11 will be described with reference to FIG. 7. As shown in FIG. 7, the pickup roller 12 and the separation block 13 are provided at an end portion in the vicinity of the printing mechanism portion 14 of the storage portion 5. The pressing plate 10*d* is supported rotatably on the inside face facing the storage portion 5 side of the lid body 10. The coil-like urging spring 10*g* is interposed between the pressing plate 10*d* and the lid body 10, so as to apply constantly an urging force which turns the pressing plate 10 in a downward direction.

Further, the sheet package 30 is mounted onto the storage portion 5 in such a way that the bottom face of the sheet 32 located at the bottommost out of sheets 32 stored inside in a stacked condition with their printing object faces directed downward is partially exposed outside the package material 31. When the lid body 10 is closed and locked, the pressing plate 10*d* is urged by the urging spring 10*g* in a downward direction, and presses the exposed portion of the sheet 32 through the package material 31 to the pickup roller 12. Consequently, the bottom face of the paper 32 makes contact with the pickup roller 12.

As shown in FIG. 7, the separation block 13 which constitutes the sheet-separating portion 11 is provided in the vicinity of, and opposite to, the pickup roller 12. The separation block 13 has a separation guide face 13*a* which is inclined with respect to a direction of feeding the sheet of the pickup roller 12. In the sheet-separating portion 11 of this configuration, a frictional conveyance force is applied to a sheet 32 located on the bottommost layer, and makes contact with the pickup roller 12 by the rotation of the pickup roller 12. Then, only the sheet 32 located at the bottommost layer is separated and fed by the separating action of the separation guide face 13*a* of the separation block 13.

Next, the printing mechanism portion 14 will be described. As shown in FIG. 7, the platen roller 16 is provided on the opposite side, which is separated by the separation block, but which is opposite to the pickup roller 12, in such a way that it can be rotated by a motor (not shown). Moreover, the paper guide 17 is disposed in the proximity of the outer circumferential face of the platen roller 16. On this paper guide 17 a concavely curved sliding contact face 17*a* having a substantially U-shaped section in a sideways cross-section is formed along the outer circumferential face of the cylindrical platen roller 16. A pressing coil spring 20 is provided between the paper guide 17 and the main body case 2. The pressing coil spring 20 urges the sliding contact face 17*a* toward the outer peripheral face of the platen roller 16.

In the printing unit 1 having such a structure, a sheet 32 separated by the sheet-separating portion 11 is carried by the pickup roller 12 in such a way that it passes between the bottom end of the separation block 13 and a guide plate 21 that directs the direction of the sheet toward the platen roller 16. Then, the sheet 32 is guided by the guide plate 21 and sent from the bottom face side of the platen roller 16 to a location between the platen roller 16 and the paper guide 17. The sheet 32 is held between the outer circumferential face of the platen roller 16 and the sliding contact face 17*a* of the paper guide 17 and then conveyed in a condition in which it is inverted into a sideways-facing letter U shape by a rotation of the platen roller 16. Then, the sheet 32 reaches the top face of the platen roller 16 such that its printing face is directed upward.

As shown in FIG. 7, the thermal head 15 located above the platen roller 16 has a heat-generating body portion 15*a* which serves as a printing portion. The thermal head 15 is provided rotatably around a rotation shaft 15*b* and the heat-generating portion 15*a* is configured so as to be capable of contacting/moving away from the top face of the platen roller 16. Further, the reason why the thermal head 15 is configured to be rotatable is that when a sheet 7 is jammed between the platen roller 16 and the paper guide 17, the thermal head 15 is prevented from becoming an obstacle to the process of removing the jammed sheet.

As shown in FIG. 7, an end of a torsion coil spring type spring 22 is attached to the thermal head 15 so as to apply in a constant manner an urging force in a direction of moving the heat-generating body portion 15*a* of the thermal head 15 close to the top face of the platen roller 16. With this configuration, the heat-generating body portion 15*a* of the thermal head 15 makes contact with the top face of a sheet 32 carried by the platen roller 16 with its printing object face directed upward as described before and then, the sheet 32 is printed at this contact position.

The thermal head 15 is of line head type, and is capable of printing any character or image on each and every line that extends in a direction perpendicular to the conveyance direction of the sheet 32 on a conveyed heat-sensitive type sheet 32. A printing width at a time of printing on a single line is set so as to be substantially equal to the width of the paper 32 which is a printing object. Because the thermal head 15 is used as a printing head, the heat sensitive paper is used as a printing object medium, and as a result consumable products such as ink and ink ribbon are rendered redundant. Further, the mechanism used for supplying ink can be eliminated and a compact structure of the printer unit 1 can thereby be achieved. As the heat sensitive paper, heat sensitive coloring type having a coloring layer which generates color when heated by the thermal head 15, and heat sensitive boring paper in which a boring layer is overlaid onto a base material layer, the boring layer being bored when heated and other types are available.

A sheet discharge guide face 13*b* which is inclined with respect to a sheet-feeding direction of the platen roller 16 is formed on the separation block 13. With this structure, after a sheet 32 is printed by the heat-generating body portion 15*a* of the thermal head 15, then it is guided by the sheet discharge guide face 13*b* and discharged onto the top side of the lid body 10 through a gap defined by the upper cover 2*c* of the main body case 2 and the lid body 10 as shown FIG. 1.

Further, as shown in FIG. 2, a pressing guide member 8 and a cutout portion 9 are provided at an edge portion that is defined by the top face portion 5*f* and the side face portion 5*e* of the storage portion 5. Two projecting portions 8*a* are provided on the side face of the pressing guide member 8 in a direction perpendicular to the side face of the sheets 32. The projecting portions 8*a* apply a pressing force to the side face of the stacked sheets 32 by pressing through each line configuration so as to arrange the sheets 32 neatly, thereby preventing the sheets from becoming skewed at a time of conveyance. A contact portion 2*f* provided with two projecting portions is formed at a portion corresponding to the pressing guide member 8 on the side face portion 5*c* such that it projects from the opposite side face portion 5*c*, like the pressing guide member 8. The cutout portion 9 is formed of a slope portion 9*b*, which is inclined toward the bottom face portion 5*a*, and two side face portions 9*a* and 9*c*, the cutout portion 9 being formed at the top face portion 5*f* of the storage portion 5. The cutout portion 9 is provided in such a way as to facilitate removal of a sheet package 30 by a user's inserting his or her finger therein in order to attach or detach the sheet package 30.

Figure 8:
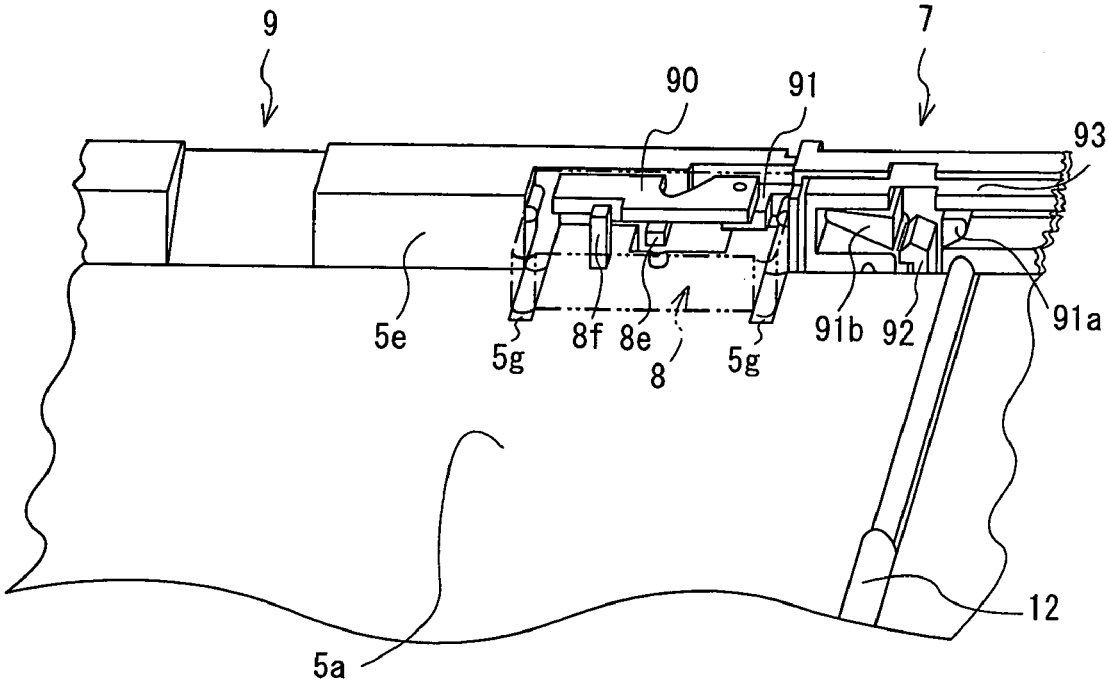
FIG. 8 is a perspective view showing the internal structure of a pressing guide member.

As shown in FIG. 8, slide grooves 5*g* are provided in a contact portion between the bottom face portion 5*a* of the storage portion 5 and the projecting portion 8*a* (see FIG. 2) of the pressing guide member 8. The slide grooves 5*g* guide for advancement and retraction of a pressing guide member 8, which will be described later, in a direction perpendicular to the longitudinal direction of the main body case 2. A cam 90 is provided within the pressing guide member 8. The cam 90 operates in an interlocked manner with a link body 91 that transmits an operation from the interlocking portion 7. The cam 90 is sandwiched between a cam presser 8*f* and the inside wall face of the main body case 2 so that its movement direction is guided in the longitudinal direction of the main body case 2. Further, a projecting piece 8*e* on which a spring 8*g* (see FIG. 11) for transmitting an urging force to the pressing guide member 8 is to be mounted is provided on the inside wall face of the main body case 2. The interlocking portion 7 is constituted of restricting blocks 91*a*, 91*b* and a stopper 92. The restricting blocks 91*a*, 91*b* are provided projectingly on the link body 91 so as to constitute an engaging portion with the lock piece 10*f* of the lid body 10. The stopper 92 inhibits unexpected operations of the link body 91.

Figure 9:
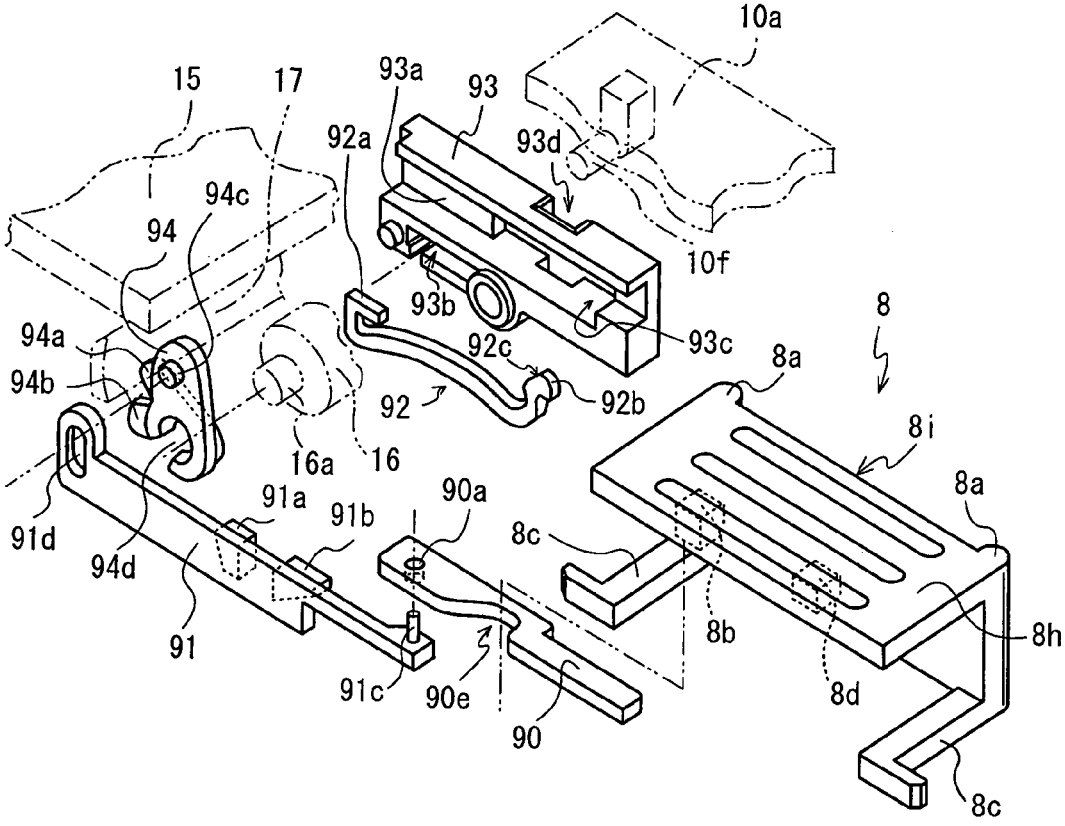
FIG. 9 is an exploded perspective view of components which constitute the link cam.

Next, the structure of the link cam constituted of the link body 91 and cams 90 and 94 will be described with reference to FIG. 9. As shown in FIG. 8, a guide supporting block 93 which constitutes a base portion of the interlocking portion 7 is fixed in such a manner that its longitudinal direction runs along the side face portion 5*e* of the storage portion 5. A face opposing the side face side of the main body case 2 of the substantially rectangular parallelepiped guide supporting block 93 is provided with a concave groove such as a lateral guide groove 93*a* running along the longitudinal direction in a substantially intermediate portion of the same face. A through portion 93*c* which penetrates the side face on the storage portion 5 side is provided in the vicinity of the intermediate portion of the concave groove. A longitudinal guide groove 93*d* in which the lock piece 10*f* of the lid body 10 can be inserted from above is provided in a vertical direction perpendicular to the lateral guide groove 93*a*. A concave fitting portion 93*b* is provided in the penetrative direction of the through portion 93*c* at an end in a longitudinal direction below the lateral guide groove 93*a*. An L-shaped cut piece 92*a* formed into an L shape at an end of the arcuate elastic stopper 92 molded of a substance such as resin is fitted to this fitting portion 93*b*.

A sheet-like portion of a slightly smaller width than the width of the groove of the lateral guide groove 93*a* of the guide supporting block 93 is formed on the link body 91. A narrow plate portion having a width substantially a half of the groove width of the lateral guide groove 93*a* is formed at an end of the same sheet-like portion, the narrow plate portion being joined therewith in an extension of the longitudinal direction. Further, a cam bearing 91*d* is formed at the other end of the sheet-like portion and into a longitudinally elongate hole at a portion which connects two focal points of an ellipse, the cam bearing 91*d* being joined at a portion at which one focal point of a substantially elliptic shape intersects with a center line of the plate width. The quadrangular prism shaped restricting block 91*a* and the triangular prism shaped restricting block 91*b* are provided projectingly in a vertical direction to the sheet surface in the vicinity of a joint portion of the sheet-like portion with the narrow plate portion on the side of a face which engages the lateral guide groove 93*a*. A cylindrical projecting pin 91*c* is provided at the tip of the narrow plate portion in the sheet sectional direction of the sheet-like portion in such a way that the projecting pin 91*c* is erected vertically.

The link body 91 is engaged with the lateral guide groove 93*a* in the guide supporting block 93 and the link body 91 is slid back and forth in a direction along this lateral guide groove 93*a*. The restricting blocks 91*a*, 91*b* of the link body 91 are exposed on the rear side of a portion that engages with the guide supporting block 93 through the through portion 93*c* provided in the lateral guide groove 93*a*. A vertical concave groove is formed by the longitudinal guide groove 93*d* and the restricting blocks 91*a*, 91*b*. A front end portion 92*b* of the stopper 92 is projected from a downward direction of the longitudinal guide groove 93*d* and the front end portion 92*b* is fitted between the restricting blocks 91*a* and 91*b*.

The cam bearing 91*d* is formed at an end of the link body 91 as a through hole. An operation shaft 94*c* of the cam 94 engages this portion. The cam 94 is formed into a substantially elliptic shape and its bottom portion is expanded so as to allow that bottom portion to be attached to the roller shaft 16*a* of the platen roller 16. The circular projecting operation shaft 94*c* is provided at one focal point of the substantially elliptic cam 94 while a roller bearing 94*d* which the roller shaft 16*a* of the platen roller 16 engages is provided at the other focal point. Substantially semi-circular cam projections 94*a*, 94*b* are formed on a rear side of the face on which the operation shaft 94*c* is formed. The cam projections 94*a*, 94*b* are projected in a direction that opposes both the thermal head 15 and the paper guide 17. The cam projections 94*a*, 94*b* of this cam 94 respectively have portions projecting principally on a radial line extending from the roller bearing 94*d* as a center line with respect to an ellipse which adopts the operation shaft 94*c* of the cam 94 and the roller bearing 94*d* as its two focal points.

The movement of the link body 91 is a one-dimensional action which oscillates in a right and left direction. However, the movement of the operation shaft 94*c* of the cam 94 is a two-dimensional action which oscillates over an upper arc of a circumference around the roller bearing 94*d* which is an engagement portion of the platen roller 16 that engages with the roller shaft 16*a*. The cam bearing 91*d* in the link body 91 is an elongated circular slide hole which enables a sliding action in a vertical direction. Because the operation shaft 94*c* oscillates in this slide hole, the link body 91 can transmit an action in a second axial direction.

The cam 90 has a joint hole 90*a* and a constricted portion 90*e*. The joint hole 90*a* is bored at an end portion in the longitudinal direction of the sheet-like body in a direction perpendicular to the sheet face. The other end portion in the longitudinal direction forms a shape that is contracted in width and the contracted portion in width is described as the constricted portion 90*e*. A somewhat narrow sheet-like body is joined to an end of the constricted portion 90*e*. Because the joint hole 90*a* is fitted to the pin 91*c* of the link body 91 from above, the link body 91 and the cam 90 are jointed together.

The pressing guide member 8 has a concave shape in its side view, and its sheet-like top face portion 8*h* and a sheet-like side face portion 8*i* perpendicular thereto are joined through their edges in the short side direction. The projecting portions 8*a* extending in the short side direction are formed at both ends of the side face portion 8*i* in a longitudinal direction. Further a projecting piece 8*d*, for mounting the spring 8*g* at a position opposing the projecting piece 8*e* of the main body case 2 is provided projectingly on the inside face side of the side face portion 8*i*. L-shaped clamping portions 8*c* are joined to each of the two angle portions on the bottom of the inside face side of the side face portion 8*i*. The clamping portions 8*c* engage the slide grooves 5*g* in the storage portion 5 slidably in order to prevent the pressing guide member 8 from slipping out of the storage portion 5. Further, a cam follower 8*b* is provided on the lower face side of the top face portion 8*h* such that it projects downward. The cam follower 8*b* engages the constricted portion 90*e* of the cam 90 in such a way as to transmit an operation of the cam to the pressing guide member 8.

Figure 10:
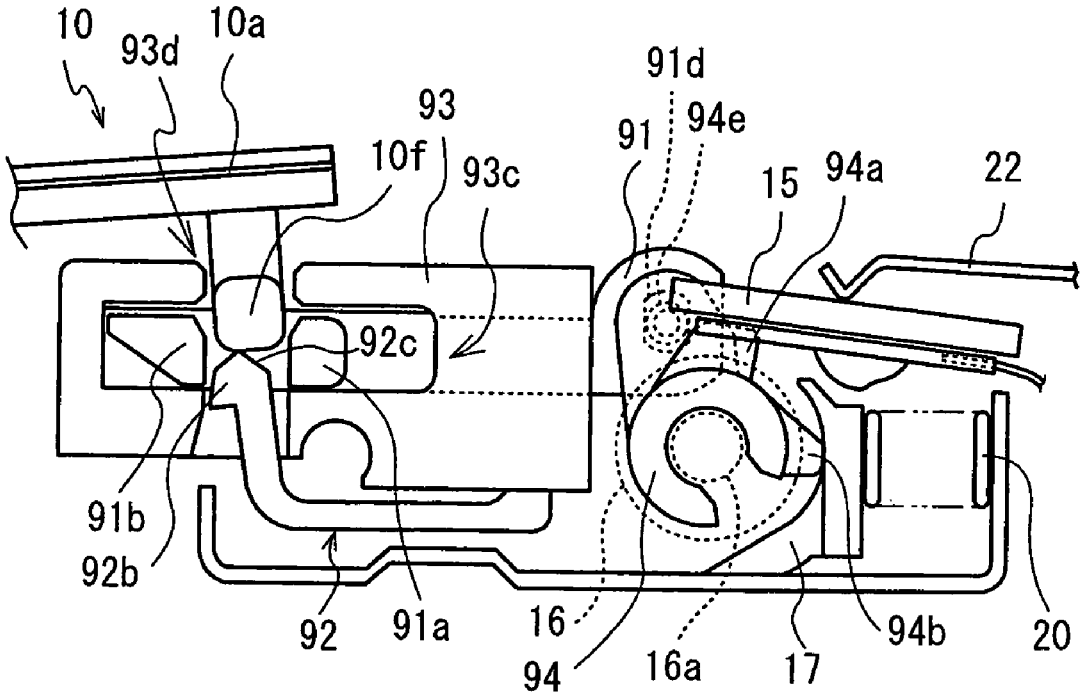
FIG. 10 is a partial sectional view of a link cam mechanism, as seen from the arrow direction with respect to the two dot and dash line II-II in FIG. 2, at a time that the lid body is opened.

Next, movements of the cam 94 at times when the lid body 10 is opened will be described with reference to FIGS. 10-14. As shown in FIG. 10, the link body 91 can move in a right and left direction along the lateral guide groove 93*a* in the guide supporting block 93. The moving range is a range in which the left side edge of the restricting block 91*b* and the right side edge of the restricting block 91*a* of the link body 91 come into contact with both side edges in a longitudinal direction of the through portion 93*c* of the guide supporting block 93. When the lid body 10 is opened, the left side edge of the restricting block 91*b* makes contact with the side edge of the through hole 93*c* so that the link body 91 is located at the left end of the range in which it can move with respect to the guide supporting block 93. At this time, a gap between the restricting blocks 91*a* and 91*b* of the link body 91 is located on a line identical to the longitudinal guide groove 93*d* of the guide supporting block 93. The front end portion 92*b* of the stopper 92 is guided by the longitudinal guide groove 93*d* without being blocked from being pressed upward and then intrudes into the gap between the restricting blocks 91*a* and 91*b*. Thus, the restricting blocks 91*a*, 91*b* are restricted in their movement to the right and left and movement of the link body 91 to the right and left is thereby locked.

Because the lock piece 10*f* of the lid body 10 is pressed from below with the front end portion 92*b* maintained in a state of contact with the lock piece 10*f*, the free end of the lid body 10 is separated from the main body case 2 slightly, and in consequence a user can perform an operation of opening the lid body 10 easily.

When the link body 91 is moved to the left end of the movable range, the operation shaft 94*c* is located on the left side with respect to the vertical line of the roller bearing 94*d*. At this time, the front end directions of the cam projections 94*a*, 94*b* with respect to the center of rotation are substantially centrifugal directions with respect to contact portions of contact between on the one hand the cam projections 94*a* and 94*b* and on the other hand both the thermal head 15 and the paper guide 17. In other words, each contact portion is pushed and moved to a position that is furthest from the center of rotation of the cam 94. The thermal head 15 and the paper guide 17 are pressed towards the center of the platen roller 16, that is, toward the center of the rotation of the cam 94 by urging forces of the springs 20 and 22. Consequently, the thermal head 15 and the paper guide 17 are pushed away from the platen roller 16 by the cam projections 94*a* and 94*b*.

Figure 11:
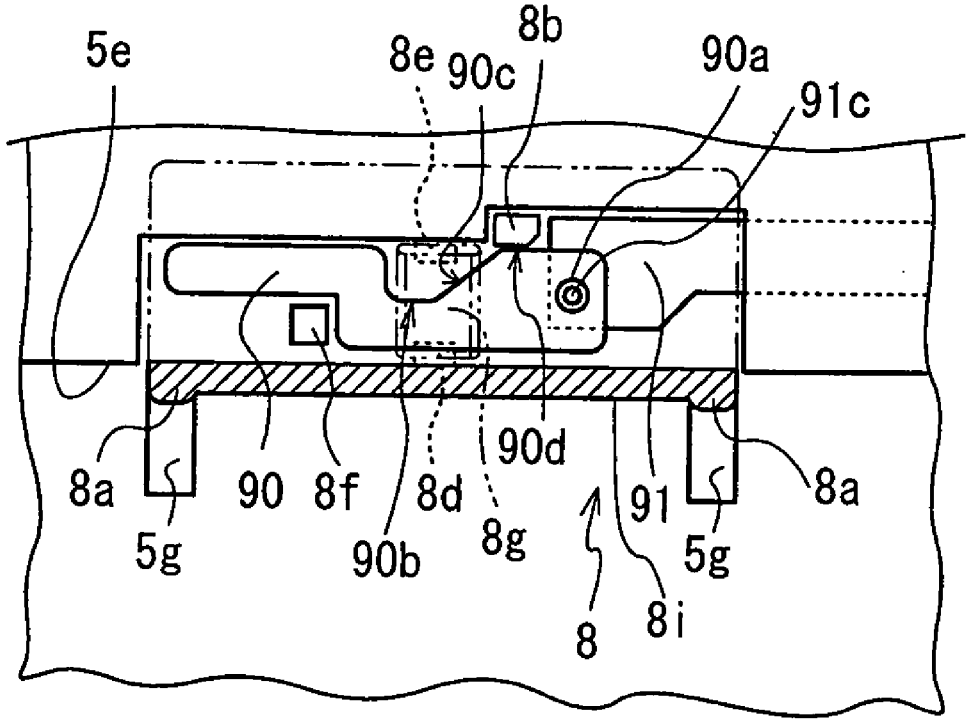
FIG. 11 is a partial sectional view showing a link cam mechanism, as seen from an arrow direction with respect to the two dot and dash line in FIG. 2, at the time that the lid body is opened.

As shown in FIG. 11, the link body 91 and the cam 90 are joined by the pin 91*c* fitted to the joint hole 90*a*. Action of the link body 91 in a right and left direction is per se transmitted to the cam 90, and the cam 90 is accordingly moved in a right and left direction. The cam 90 is kept in contact with the cam presser 8*f* so as to inhibit the action of the cam 90, whereby being always kept in firm contact with the inside wall face of the main body case 2. Further, a pressing force is always applied to the pressing guide member 8 in a direction (downward in the Figure) away from the inside wall face of the main body case 2. Further, the spring 8*g* is fitted to the projecting piece 8*d* provided on the pressing guide member 8 and to the projecting piece 8*e* provided on the inside wall face of the main body case 2.

When the lid body 10 is opened, the link body 91 is moved to the left end of its movable range and accompanied therewith, the cam 90 is also moved in a leftward direction. The cam follower 8*b* provided projectingly on the pressing guide member 8 is pressed downward with respect to the cam 90 by an urging force of the spring 8*g*. However, because the relative positional relationship in a vertical direction between the cam 90 and the inside wall face of the main body case 2 remains unchanged, the cam follower 8*b* is guided in its movement by an action surface of the cam 90. In other words, when the lid body 10 is opened, the link body 91 is moved to the left end of the movable range, and in consequence the cam follower 8*b*, which is pressed by the urging force of the spring 8*g* against the cam 90, is moved along a concave face 90*b* and a slope 90*c* up to a convex face 90*d*. Because the cam follower 8*b* is moved vertically relative to movement of the cam 90 in a right and left direction, the cam follower 8*b* is moved to a position which is nearest to the inside wall face of the main body case 2. The pressing guide member 8 joined to the cam follower 8*b* is moved in an upward direction corresponding to the action of the cam follower 8*b*. Thus, the pressing guide member 8 releases the side faces of sheets 32 set in the storage portion 5 from their pressed state.

Figure 12:
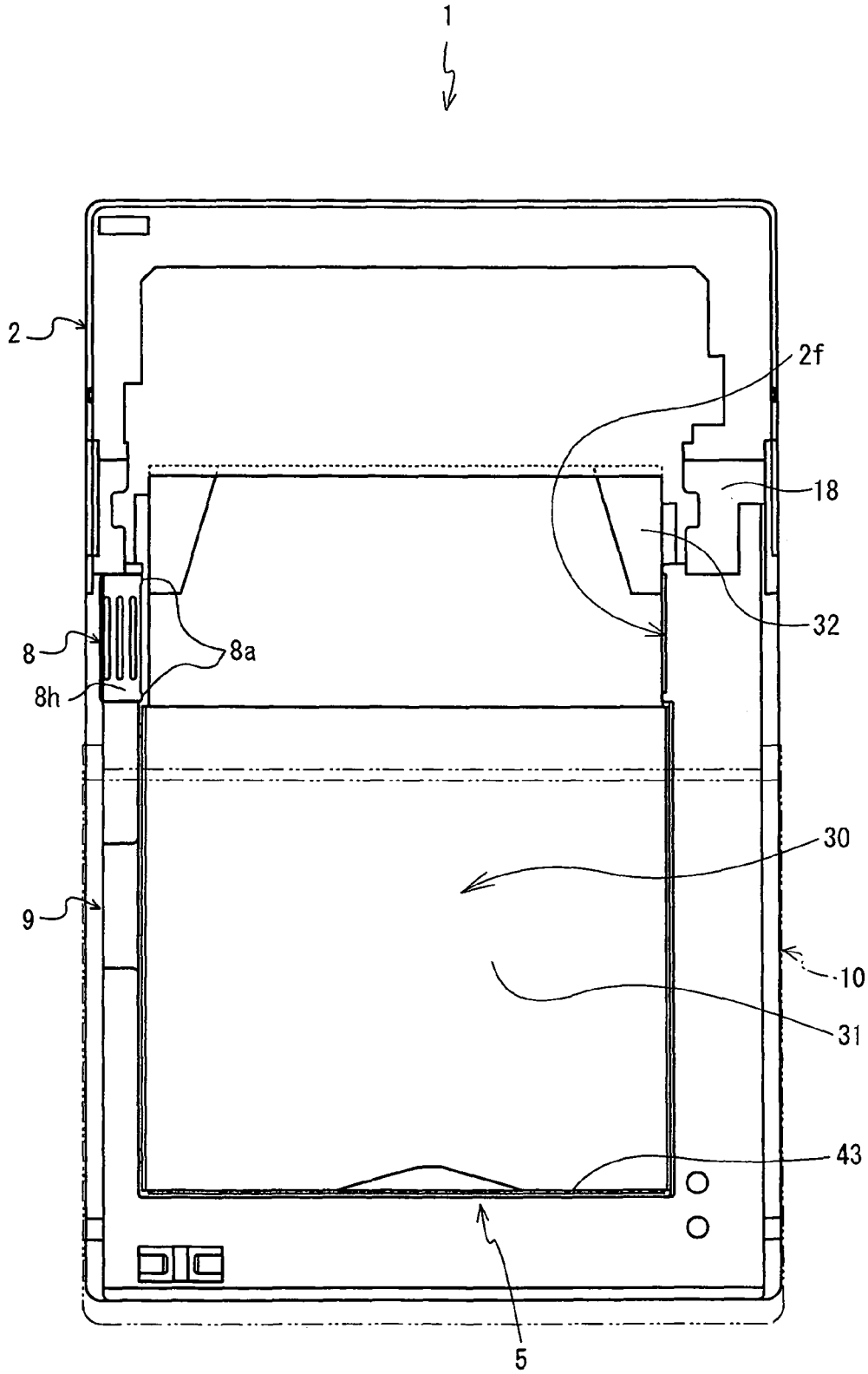
FIG. 12 is a plan view of a printing unit at the time that the lid body is opened.

As shown in FIG. 12, the sheet package 30 is loaded onto the storage portion 5 of the printing unit 1 in such a way that a side covered by a side wall portion 43 of the package material 31 is located on the fixed end portion of the lid body 10 with respect to the main body case 2. Contact is made by the contact member 2*f* with a side edge on the side of the contact member 2*f* (at the bottom in the Figure) of a side edge in the longitudinal direction of the exposed sheets 32, so that a gap created between the side edge in the longitudinal direction of the package material 31 and the side edge in the longitudinal direction of the sheets 32 is filled. Further, a space is created between the side edge on the left side of the sheets 32 and the pressing guide member 8 that has interlocked and moved to the left because the lid body 10 was opened. In this manner the sheets 32 attain a non-fixed state. When a user takes out the sheet package 30 by inserting his or her finger into the cutout portion 9, the sheet package 30 can be taken out easily because it is not fixed.

Figure 13:
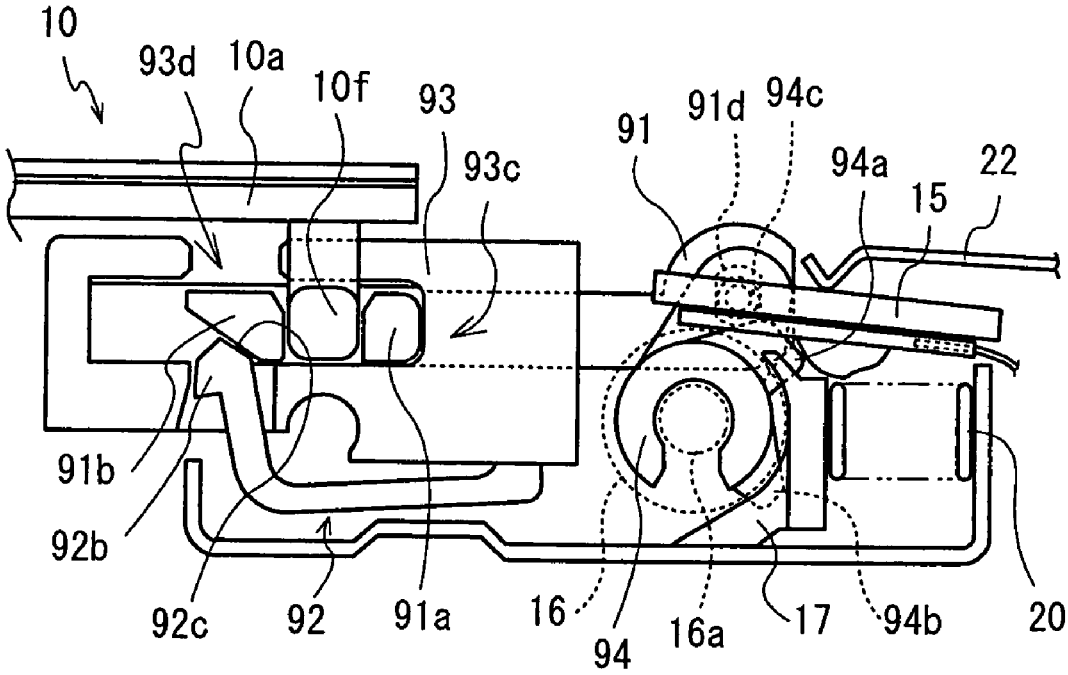
FIG. 13 is a partial sectional view of a link cam mechanism as seen from an arrow direction with respect to the two dot and dash line II-II in FIG. 2, at a time that the lid body is closed.

Next, an action of the cam 94 when the lid body 10 is closed will now be described with reference to FIG. 13 and FIG. 14. When the lid body 10 is closed, the lock piece 10*f* of the lid body 10 is sandwiched between the restricting blocks 91*a* and 91*b* and moved to the right side. In consequence, the restricting blocks 91*a*, 91*b* are also moved to the right side. The right side edge portion of the restricting block 91*a* keeps contact with the side edge of the through portion 93*c* and the link body 91 is located at the right end of the range in which it can move with respect to the guide supporting block 93. At this time, the gap between the restricting blocks 91*a* and 91*b* of the link body 91 is located on a line that is identical to the longitudinal guide groove 93*d* in the guide supporting block 93. The front end portion 92*b* of the stopper 92 is guided by the longitudinal guide groove 93*d* and intrudes to the left side of the restricting block 91*b*. Further, a slope 92*c* possessed by the front end portion 92*b* of the stopper 92 makes contact with a slope possessed by the restricting block 91*b* in such a way that it becomes substantially parallel thereto. An urging force of the stopper 92 applied to the front end portion 92*b* in an upward direction is transmitted to the restricting block 91*b* through the slope 92*c*, and the link body 91 is accordingly subjected to an urging force of movement to the right side. For this reason, the movement of the link body 91 in the leftward direction is inhibited and movement of the link body 91 towards the right side is restricted by the restricting block 91*a* which keeps contact with the side edge of the through portion 93*c*. Consequently, movement of the link body 91 in a right and left direction is locked. The lock piece 10*f* of the lid body 10 that is sandwiched between the restricting blocks 91*a* and 91*b* is fixed within the guide supporting block 93 so as to lock the lid body 10 and to prevent the lid body 10 from being opened.

When the link body 91 is moved to the right end of the movable range, the operation shaft 94*c* is located to the right side with respect to the vertical line of the roller bearing 94*d*. At this time, the directions of the front ends of the cam projections 94*a*, 94*b* with respect to the center of the rotation are caused to deviate from the substantially radial direction with respect to the contact portions between on the one hand the cam projections 94*a* and 94*b* and on the other hand both the thermal head 15 and the paper guide 17. In other words, the contact portions respectively make contact with the side faces of the cam projections 94*a* and 94*b*. The thermal head 15 and the paper guide 17 are accordingly pressed toward the center of rotation of the platen roller 16, that is, toward the center of rotation of the cam 94 by an urging force of the springs 20, 22. Consequently, the thermal head 15 and the paper guide 17 are released from contact with the front ends of the cam projections 94*a*, 94*b*, and they are accordingly pushed in a direction of making firm contact with the platen roller 16.

Figure 14:
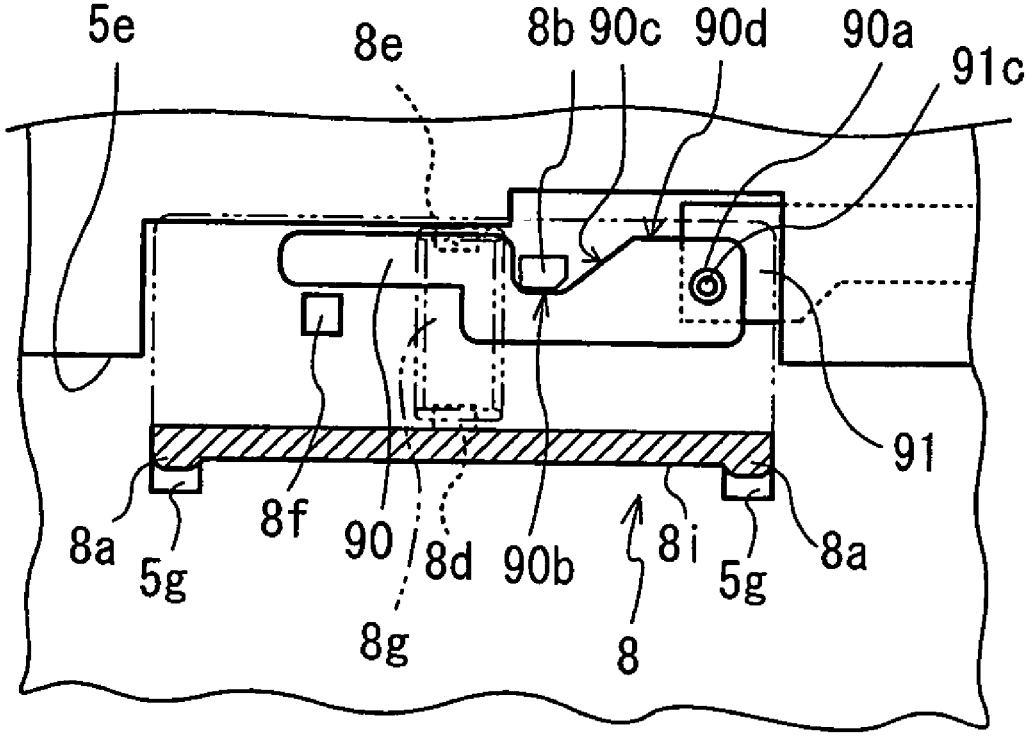
FIG. 14 is a partial sectional view of a link cam mechanism, as seen from an arrow direction with respect to the two dot and dash line in FIG. 2, at a time that the lid body is closed.

When the lid body 10 is closed, as shown in FIG. 14, the link body 91 is moved to the right end of the movable range and accompanied therewith, the cam 90 is also moved to the right. The cam follower 8*b* provided projectingly on the pressing guide member 8 is pushed downward with respect to the cam 90 by the urging force of the spring 8*g*. However, because the relative positional relationship between the cam 90 and the inside wall face of the main body case 2 remains unchanged, the cam follower 8*b* is guided in its movement by the action surface of the cam 90. In other words, when the lid body 10 is closed, the link body 91 is moved to the right end of the movable range, and the cam follower 8*b*, which is pressed by the urging force of the spring 8*g* against the cam 90, is moved along the convex face 90*d* and the slope 90*c* of the cam 90 up to a position on the concave face 90*b* with which it makes contact. Because the cam follower 8*b* is moved vertically while the cam 90 is being moved in a right and left direction, the cam follower 8*b* is moved up to a position that is furthest away from the inside wall face of the main body case 2. The pressing guide member 8, which is joined to the cam follower 8*b*, is moved in a downward direction accompanied with an action of the cam follower 8*b*. Thus, the pressing guide member 8 presses the side faces of the sheets 32 set in the storage portion 5.

The side edge on the left side of the sheets 32 is pressed by the pressing guide member 8 which is interlocked when the lid body 10 is closed and moved in the direction of pressing the sheets 32 (an upward direction in FIG. 12). The stacked sheets 32 are arranged by the urging force of the pressing guide member 8 in such a way that the sheets 32 are sandwiched between the pressing guide member 8 and the contact member 2*f* that opposes it. Further, both end portions in the short side direction of the sheets 32 are subjected to linear pressure from the projecting portions that are provided projectingly on the pressing guide member 8 and on the contact member 2*f*. Accordingly, the sheets 32 are rearranged in a longitudinal direction so as to become parallel to a conveyance direction of the sheets 32, and the sheets 32 are thus prevented from being skewed.

Next, the sheet package 30 according to the first embodiment of the present disclosure which is set in the printing unit 1 will be described in detail with reference to FIG. 15 to FIG. 25.

Figure 15:
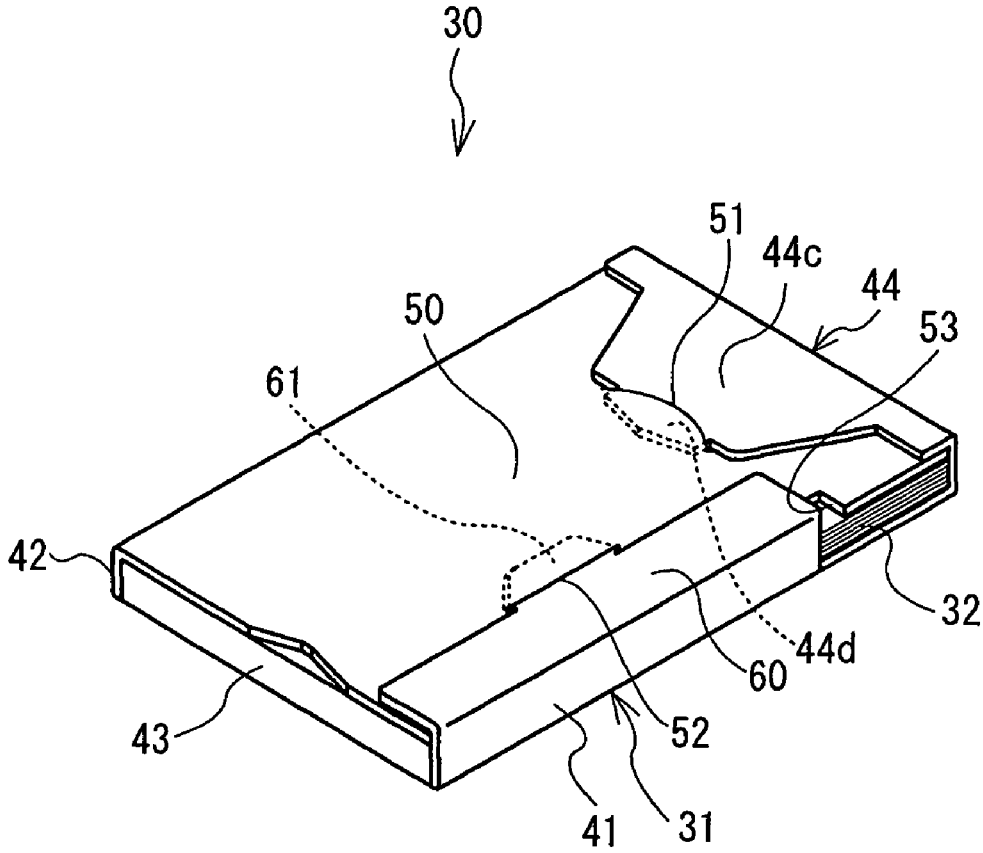
FIG. 15 is a perspective view of a sheet package.
Figure 16:
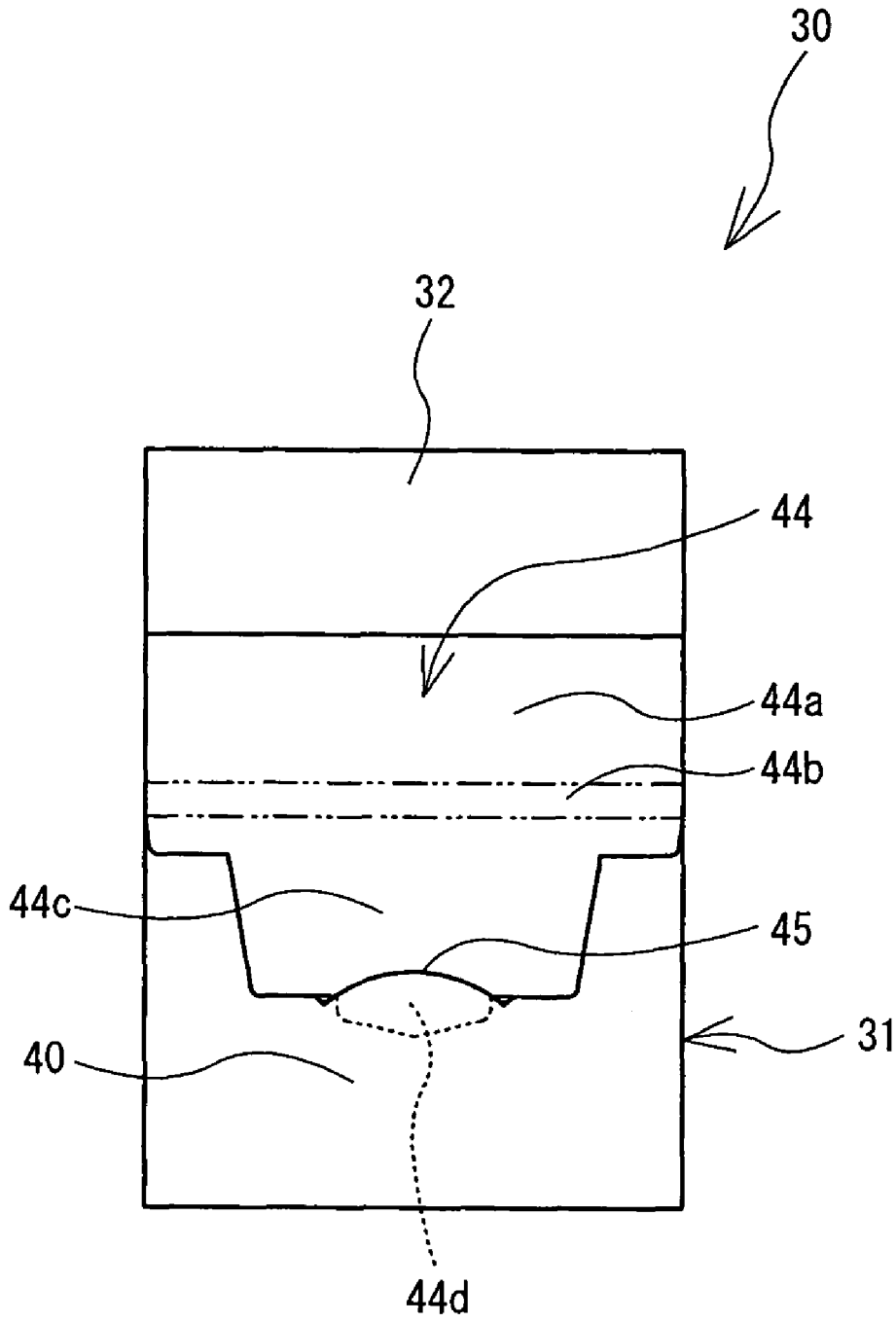
FIG. 16 is a bottom view of the sheet package.

As shown in FIG. 15, the sheet package 30 is constructed of a package material 31 which is folded into a rectangular parallelepiped thin box. This sheet package 30 contains a plurality of sheets (recording object medium) 7 composed of A6 size or similar size cut-sheet like heat sensitive papers in a stacked condition. Users purchase sheet packages 30 that are put on sale in the box-type condition shown in FIG. 15. As shown in FIG. 4 and FIG. 16, a lid portion 44 is opened and folded back to the rear side. Then, users insert an insert portion 44*d* of the lid portion 44 into a third slit 45 in a bottom portion 40, which will be described later, so as to expose the sheets 32 inside. Then, a user sets the sheets, together with the package material 31 in the sheet storage portion 5 of the printing unit 1. When a sheet package 31 is not loaded on the printing unit 1, the lid portion 44 enables the sheets to be stored in such a way that they are not exposed outside. When the sheet package 30 is loaded onto the printing unit 1, part of the sheets 32 can be exposed outside the package material 31 by folding back to the other side.

Figure 17:
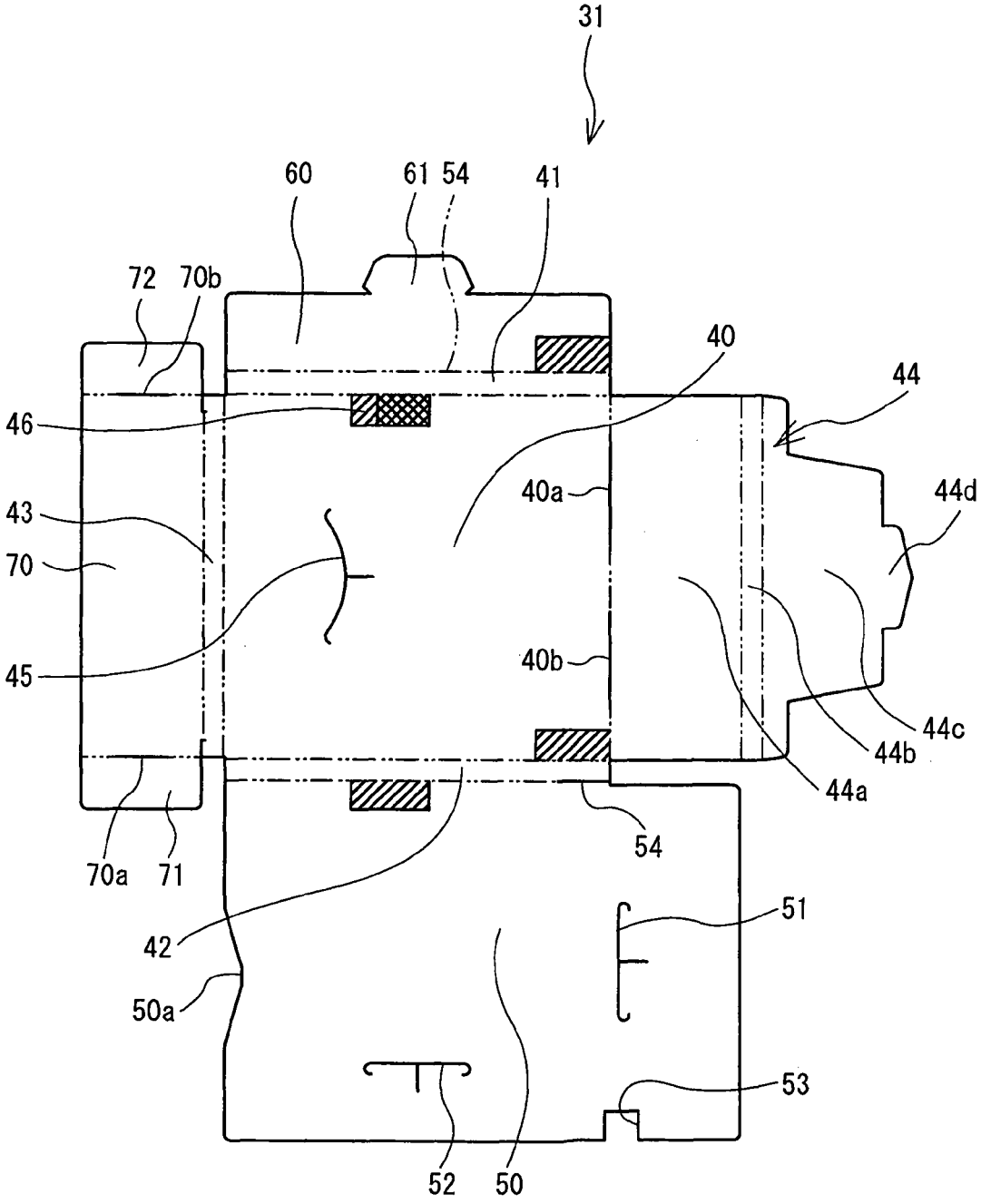
FIG. 17 is an exploded view of the unfolded package material as seen from its exterior.
Figure 18:
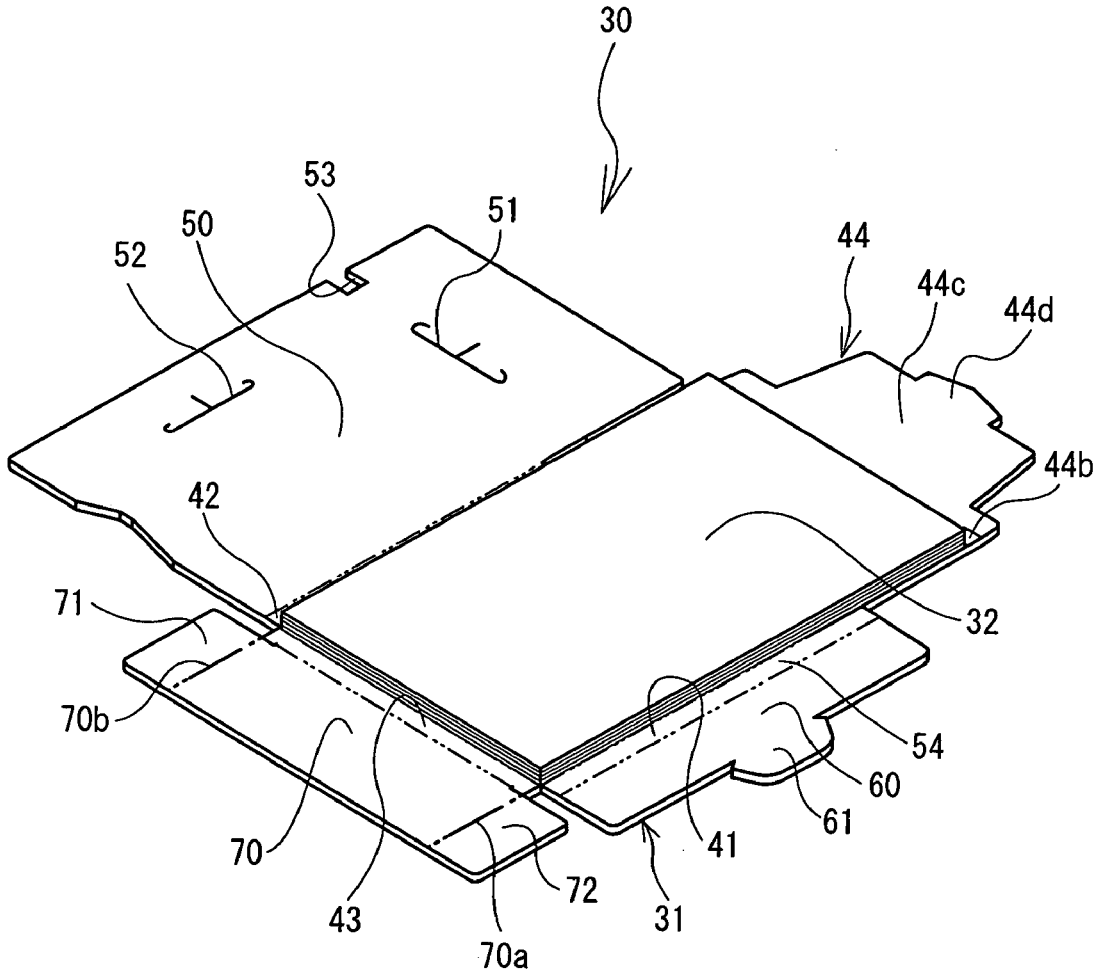
FIG. 18 is a perspective view of an unfolded condition of the package material as seen from the interior.

Next, the structure of the package material 31 will be described with reference to FIGS. 17, 18. As shown in FIGS. 17, 18, the package material 31 is formed by punching out a flat thick paper. The rectangular bottom portion 40 that covers one face in a stack direction of the stacked sheets 32 is provided in the central portion of the package material 31. A rectangular side wall portion 42 is extended from one of a pair of side end portions of the bottom portion 40 while a rectangular side wall portion 41 is extended from the other side end portion. A rectangular side wall portion 43 is extended from the rear end portion of the bottom portion 40. The heights of the side wall portions 41-43 (width in a short side direction) are all the same and greater than the stack height of the sheets 32 stored in the sheet package 30.

As shown in FIGS. 17, 18, the lid portion 44 is extended from the front end side of the bottom portion 40. This lid portion 44 is comprised of a rectangular lid base portion 44*a*, a lid side wall portion 44*b*, a lid front end portion 44*c* and the insert portion 44*d*. The lid base portion 44*a* forms a rectangular shape. The lid side wall portion 44*b* is extended from the lid base portion 44*a*, forming a rectangular shape having the same height (width in the short side direction) as the heights of the side wall portions 41-43. The lid front end portion 44*c* is extended from the lid side wall portion 44*b* and the width thereof is less than that of the lid side wall portion 44*b*. The insert portion 44*d* is extended from the lid front end portion 44*c* and the width thereof is less than that of the lid front end portion 44*c*. A pair of inclined sides is provided at the front end at the insert portion 44*d*. A shape which combines that of the bottom portion 40 with that of the lid base portion 44*a* is of substantially the same shape as the sheet 32. Cut-in portions 40*a* and 40*b* (indicated by solid lines) of a predetermined length are provided on a border between the bottom portion 40 and the lid base portion 44*a* with a predetermined interval therebetween. By reducing a repellent force when the lid portion 44 is folded back, these cut-in portions 40*a* and 40*b* can prevent the sheet package 30 from floating upwards. Further, because the cut-in portions 40*a* and 40*b* are not contiguous cut-in portions, but are rather separated by a connecting portion located in a center of a gap between them, the lid portion 44 can be protected from being broken or torn on occasions that the cut-in portions 40*a* and 40*b* are become tangled with another member.

As shown in FIG. 17 and FIG. 18, a rectangular first sheath portion 50, which covers the sheets 32 such that it opposes the bottom portion 40 after a construction is extended from the side wall portion 42 of the bottom portion 40. This first sheath portion 50 has a first engagement slit 51 in which the insert portion 44*d* of the lid portion 44 can be inserted, a second engagement slit 52 in which an insert portion 61 of a second sheath portion 60 can be inserted and a concave portion 50*a* which is a trapezoidal dent. A square cutout portion 53 which serves as a detecting cutout portion for detecting the presence/ absence of a sheet 32 is provided in a side end portion on the lid base portion 44*a* side of the first sheath portion 50. The printing unit 1 examines whether or not a sheet 32 is present by means of this cutout portion 53. That is, the sheet package 30 is loaded on the sheet storage portion 5 of the printing unit 1 the a state shown in FIG. 4, and the printing unit 1 is provided with a reflection type optical sensor 80 (see FIGS. 5, 7) at a position that opposes the cutout portion 53. Thus, when any sheet 32 is present in the sheet package 30, the reflection type optical sensor detects reflection light from a sheet 32 and if no sheet 32 is present, the reflection type optical sensor detects reflection light from a synthetic resin which constitutes the rear face of the lid body 10. Therefore, if the color of the synthetic resin which constitutes the sheet storage portion 5 is set to a color having a low reflectance ratio, the presence/absence of a sheet can be easily detected.

As shown in FIG. 17, three sensor marks 46 which indicate the type and size of the sheets 32 stored in the sheet package 30 are printed on an end portion on the first sheath portion 50 side of the bottom portion 40 on the front side (outer side) of the package material 31. A sensor mark 46 is read by a reflection type optical sensor (a sensor (not shown) that is different from the reflection type optical sensor 80 provided on the printing unit 1. For example, if the presence of a sensor mark 46 is designated as "1" and the absence thereof is designated as "0", the absence of a sheet package and seven types of the sheets 32 can be identified by use of the three sensor marks 46. The bottom portion 40 is provided with the third slit 45 in which the insert portion 44*d* of a folded back lid portion 44 can be inserted. Further, a cut-in portion 54 which is cut in a predetermined length from the cutout portion 53 side is provided between the side wall portion 42 and the first sheath portion 50. This cut-in portion 54 facilitates deflection of the first sheath portion 50 when the first sheath portion 50 is pressed by the pressing plate 10*d* if the sheet package 30 is loaded on the sheet storage portion 5.

As shown in FIGS. 17 and 18, a second sheath portion 60 for purposes of fixing the first sheath 50, covers the sheets 32 in such a way that they opposes the bottom portion 40 after assembly, is extended from the side wall portion 41 of the bottom portion 40. The width of the second sheath portion 60 is less than that of the first sheath portion 50, and the insert portion 61 is formed on its side end portion. When a sheet package 30 is assembled, the insert portion 61 is inserted into the second engagement slit 52 in the first sheath portion 50 so as to fix the first sheath portion 50.

As shown in FIGS. 17 and 18, a rectangular tongue portion 70 is extended from the side wall portion 43 of the bottom portion 40 and when a sheet package 30 is assembled, the tongue portion 70 receives the bottom end portion of the sheets 32. Rectangular ear portions 71 and 72 are provided on both end portions in a longitudinal direction of the tongue portion 70. When the ear portions 71 and 72 are bent, they function as a pressing member for preventing the sheets 32 located in the sheet package 30 from dropping down as a result of the lid portion 44 being opened, and as a sheet intrusion prevention member for preventing a discharged sheet from being inserted once again. The width in a sheet discharge direction of this tongue portion 70 is set at least a third or more the length in the sheet discharge direction of the bottom portion 40 and when a sheet 32 marginally comes out in a discharge direction from the sheet package 30, the ear portions 71 and 72 are contrived not to inhibit a sheet 32 from being returned to its original position. A portion indicated with two dots and a dash line in FIG. 17 and FIG. 18 indicates a portion subjected to fold line processing and the fold line facilitates bending of a thick paper for convenience of assembly. Further, a cut-in portion 70*a* is formed on a border between the ear portion 71 and the tongue portion 70 and a cut-in portion 70*b* is formed on a border between the ear portion 72 and the tongue portion 70. The cut-in portions 70*a* and 70*b* are intended to prevent the resistance by conveyance of a sheet 32 from the sheet package 30 from affecting badly the quality of printing when the degree of pressing force of the ear portion 71 and the ear portion 72 to the sheets 32 is increased to a level that is beyond what is necessary.

Figure 19:
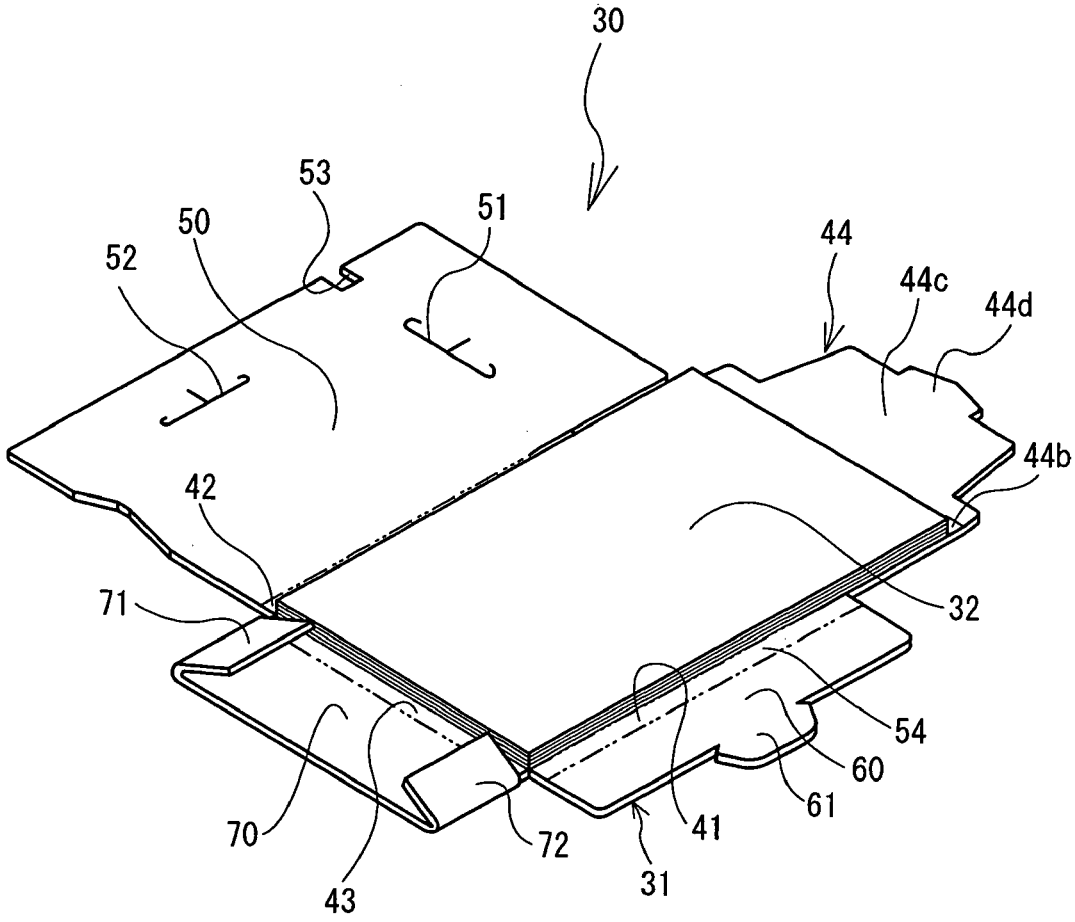
FIG. 19 is a perspective view showing a process of manufacturing the sheet package.
Figure 20:
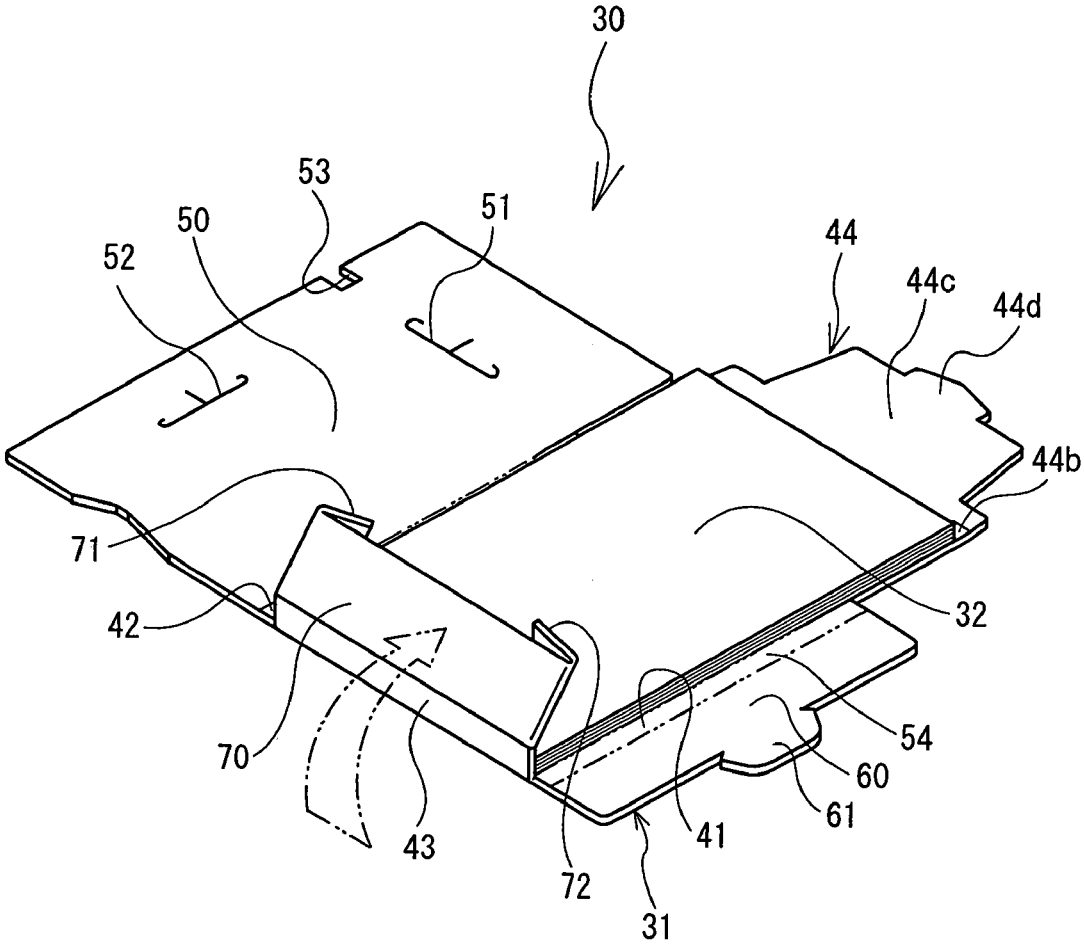
FIG. 20 is a perspective view showing a process of manufacturing the sheet package.
Figure 21:
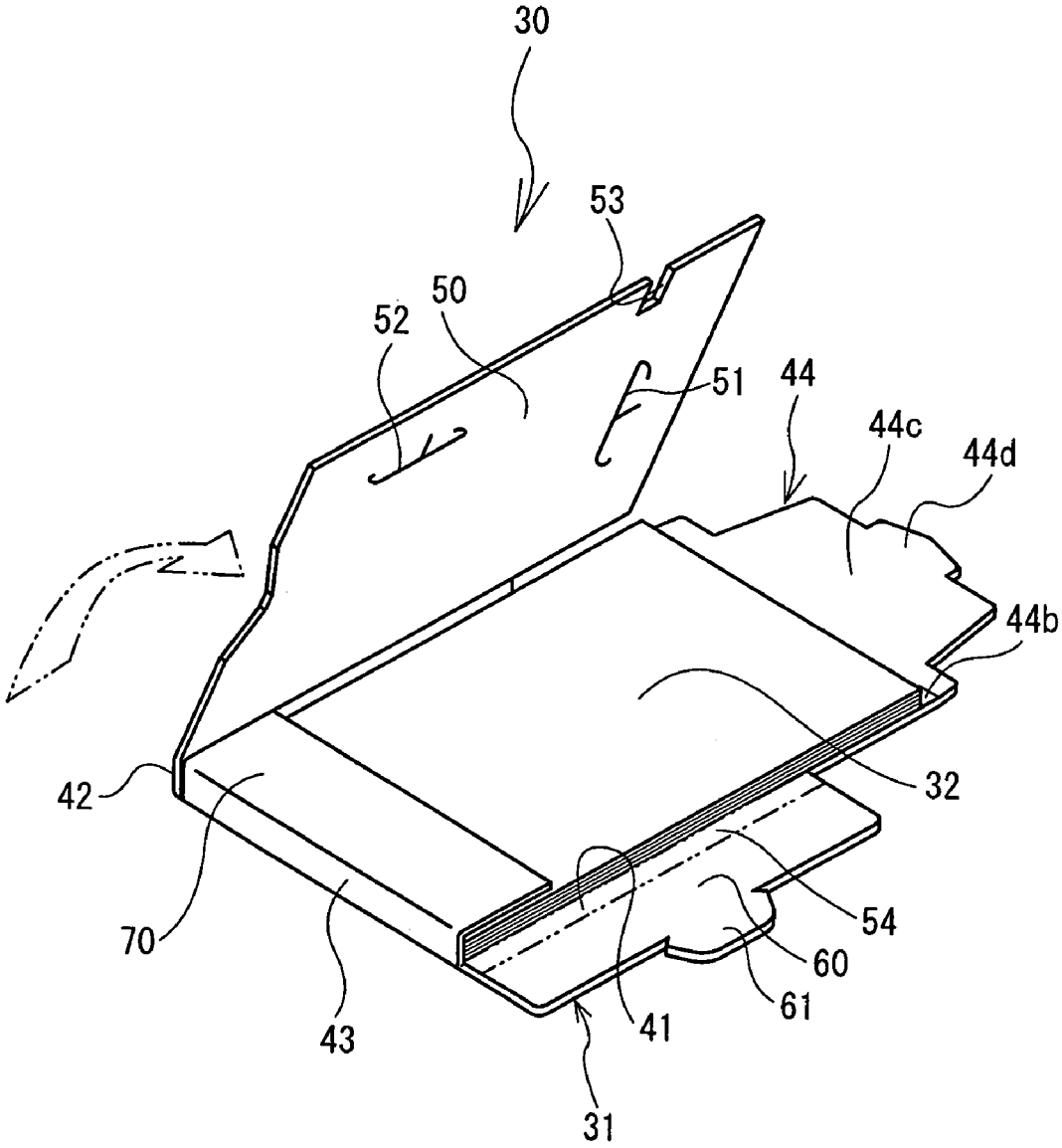
FIG. 21 is a perspective view showing a process of manufacturing the sheet package.
Figure 22:
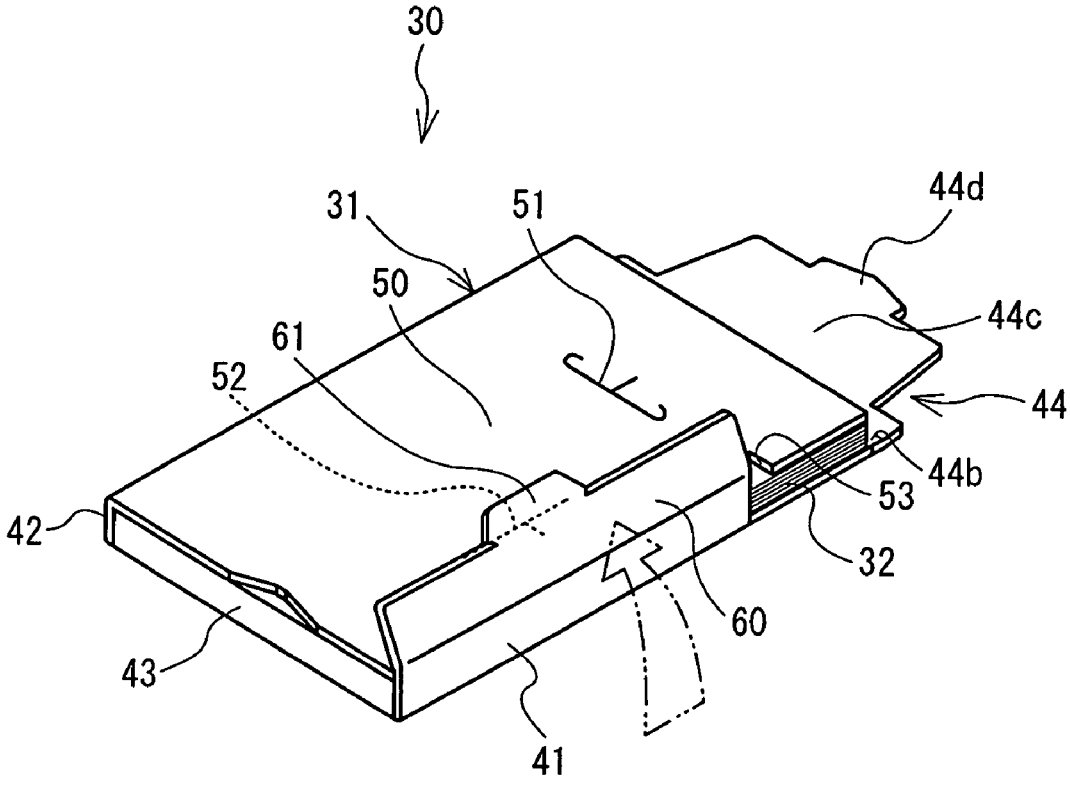
FIG. 22 is a perspective view showing a process of manufacturing the sheet package.

Next, a manufacturing process of a sheet package 30 will be described with reference to FIGS. 19-23. As shown in FIG. 19, the ear portions 71 and 72 located at both end portions in a longitudinal direction of the tongue portion 70 are folded back and the stacked sheets 32 are loaded on the bottom portion 40. Next, as shown in FIG. 20, the tongue portion 70 of the package material 31 is bent in an upward direction, and the tongue portion 70 is folded such that it overlaps with the sheet 32. Next, as shown in FIG. 21, the first sheath portion 50 is bent in such a way that it overlaps with the top of the tongue portion 70 and as shown in FIG. 22, the second sheath portion 60 is bent in an upward direction and folded over the first sheath portion 50. Next, the insert portion 61 of the second sheath portion 60 is inserted into the second slit 52 in the first sheath portion 50.

Figure 23:
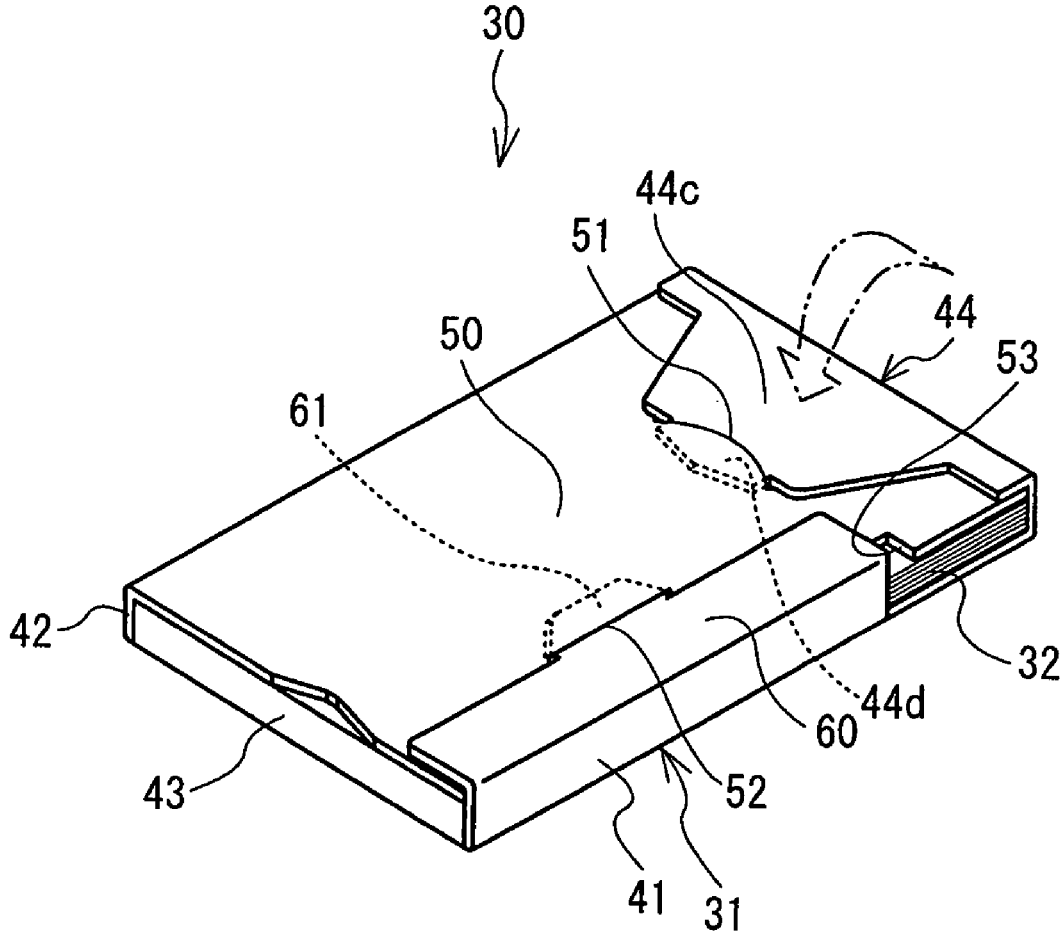
FIG. 23 is a perspective view showing a process of manufacturing the sheet package.

Finally, as shown in FIG. 23, the lid portion 44 is bent over the first sheath portion 50, the insert portion 44*d* of the lid portion 44 is inserted into the first slit 51 in the first sheath portion 50, and the sheet package is thus completed. The sheet package 30 is sold in this condition. Furthermore, because in this condition, the side wall portion 41 side of a sheet package 30 is not provided with any cut-in portion 54, and the second sheath portion 60 is folded over the first sheath portion 50, the degree of stiffness of the side end portion on the side wall portion 41 side of a sheet package 30 is greater than that of the stiffness of the side end portion of the side wall portion 42. In the sheet package 30, because an attempt is made to restore the ear portions 71 and 72 elastically, they press the surface of the stacked sheets 32.

A method of using the sheet package 30 will now be described with reference to FIGS. 2, 4, 5, 6, 16, 24, 25, 26 and 27.

Figure 24:
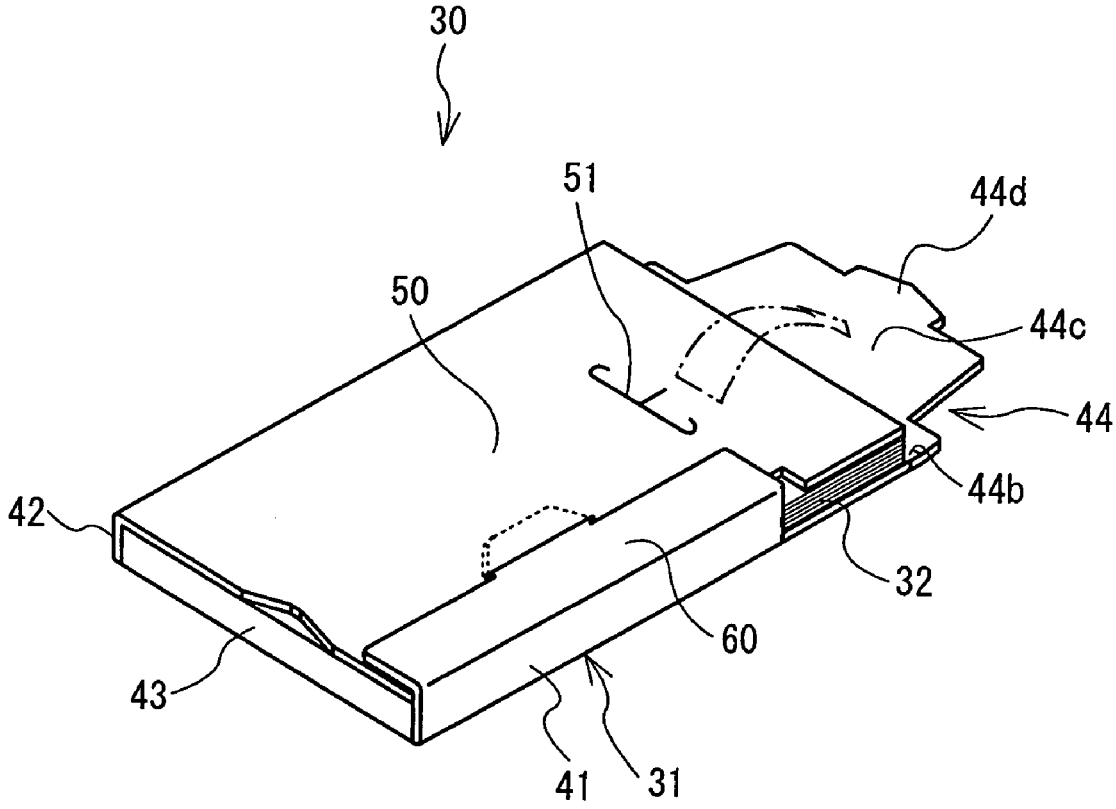
FIG. 24 is a perspective view showing a state in which the lid portion is folded back at a time that the sheet package is used.
Figure 25:
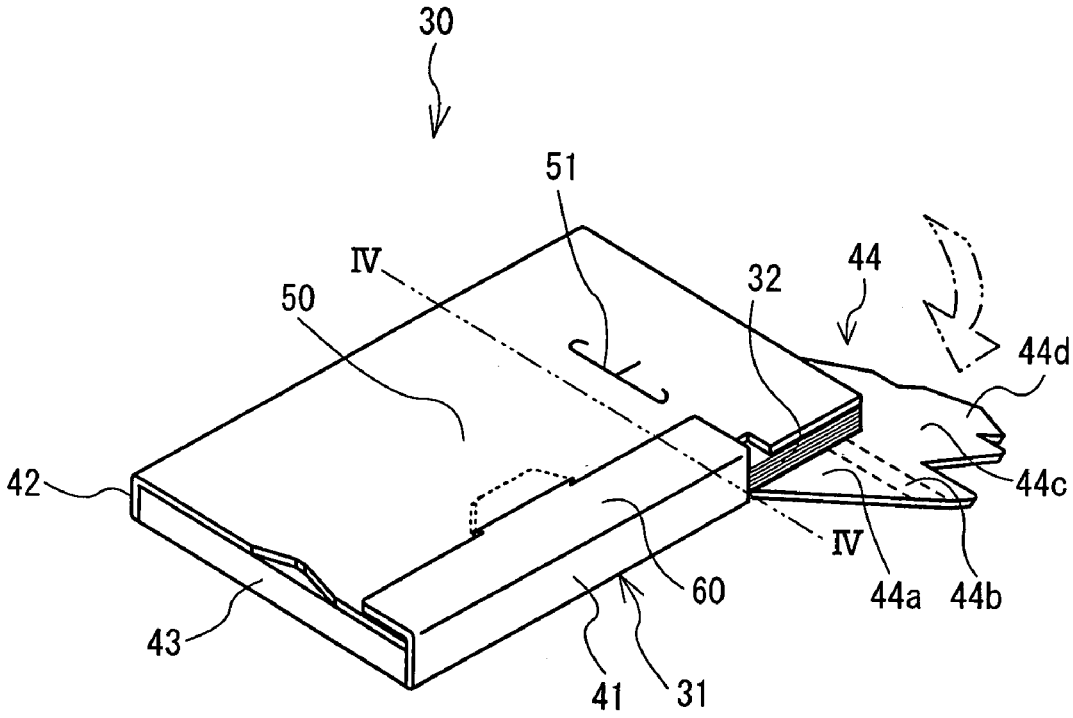
FIG. 25 is a perspective view showing a state of folding back the lid portion when the sheet package is used.

At a time when a sheet package 30 is used, the insert portion 44*d* of the lid portion 44, an insert portion which is inserted into the first engagement slit 51 of the first sheath portion 50 as shown in FIG. 23, is pulled out of the first engagement slit 51 as shown in FIG. 24 and then the lid portion 44 is raised. Then, as shown in FIG. 25, the lid portion 44 is folded back to the rear side along the line IV-IV. As shown in FIG. 16, the insert portion 44*d* of the lid front end portion 44*c* of the lid portion 44 is inserted into the third slit 45 of the bottom portion 40 so as to fix the lid portion 44 to the bottom portion 40. Consequently, as shown in FIG. 4, the front end portions of the sheets 32 are exposed from the sheet package 30.

Figure 26:
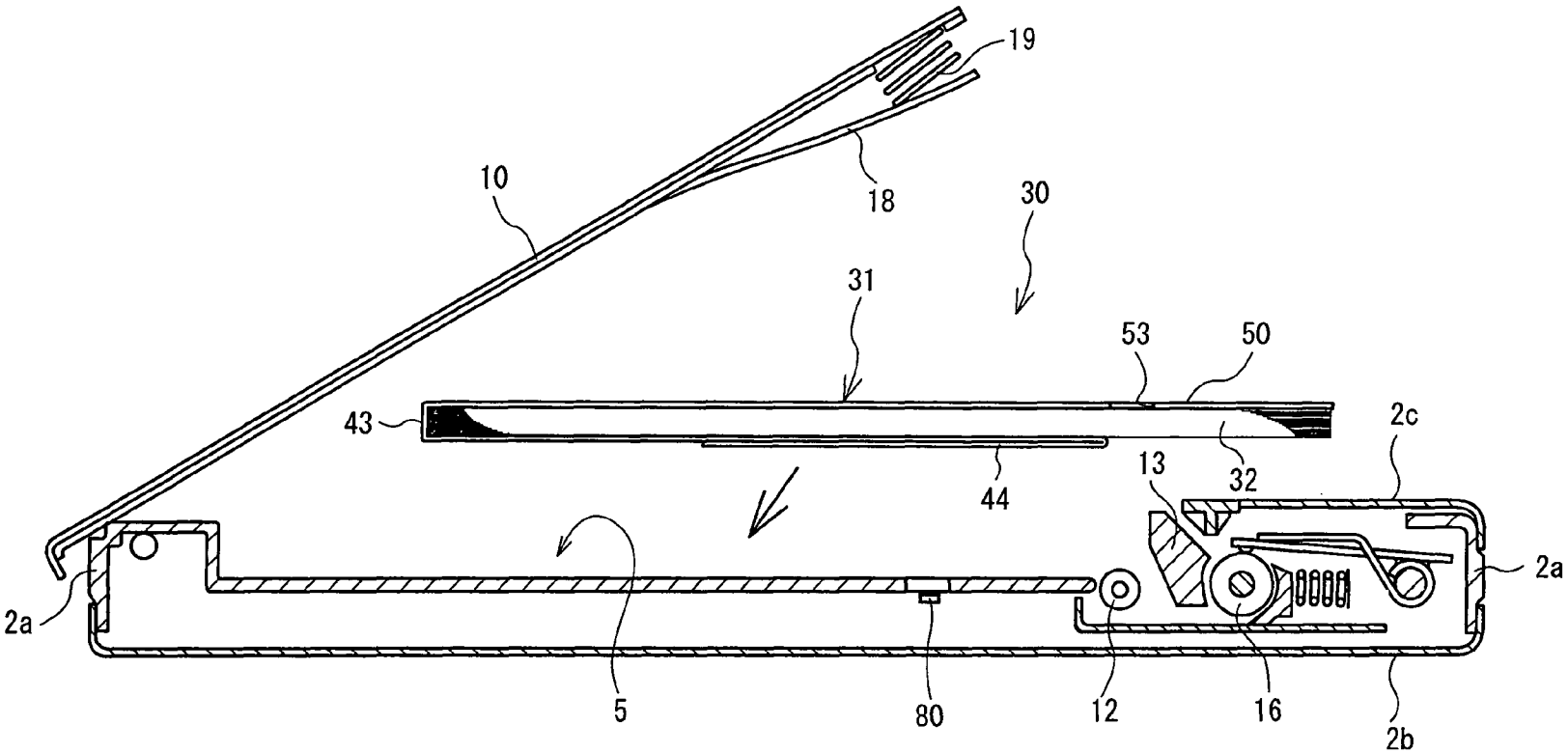
FIG. 26 is a side view showing an operation of loading the sheet package to the printing unit.

A sheet package 30 in such a state is fitted to the storage portion 5 shown in FIG. 2 with the side wall portion 43 side at the rear end of the sheet package 30 placed therein first as shown in FIG. 26. When a sheet package 30 is correctly loaded onto the storage portion 5, the sheet package 30 is stored within the storage portion 5 without being mounted onto the contact member 2*f* as shown in FIG. 6. At this time, the side wall portion 42 of the sheet package 30 is pressed by the pressing guide member 8 in such a way that the side wall portion 41 of the sheet package 30 is pressed against the contact member 2*f*. In consequence, the sheet package 30 is positioned in the storage portion 5 in a width direction perpendicular to a sheet discharge direction and is fixed therein.

When the lid body 10 is closed, the first sheath portion 50 of the sheet package 30 is pressed by the pressing plate 10*d*, and as a result, the sheet on the bottommost layer of the stacked sheets 32 is pressed against the pickup roller 12.

At this time, the reflection type optical sensor 80 provided on the printing unit 1 opposes the cutout portion 53 provided in the first sheath portion 50 of the sheet package 30 (see FIGS. 5,7). Therefore, if a sheet 32 is present in the sheet package 30, the reflection type optical sensor 80 detects a reflection light from the sheet 32. If, however, no sheet 32 is present, a reflection light from synthetic resin which constitutes the rear face of the lid body 10 is detected.

Figure 27:
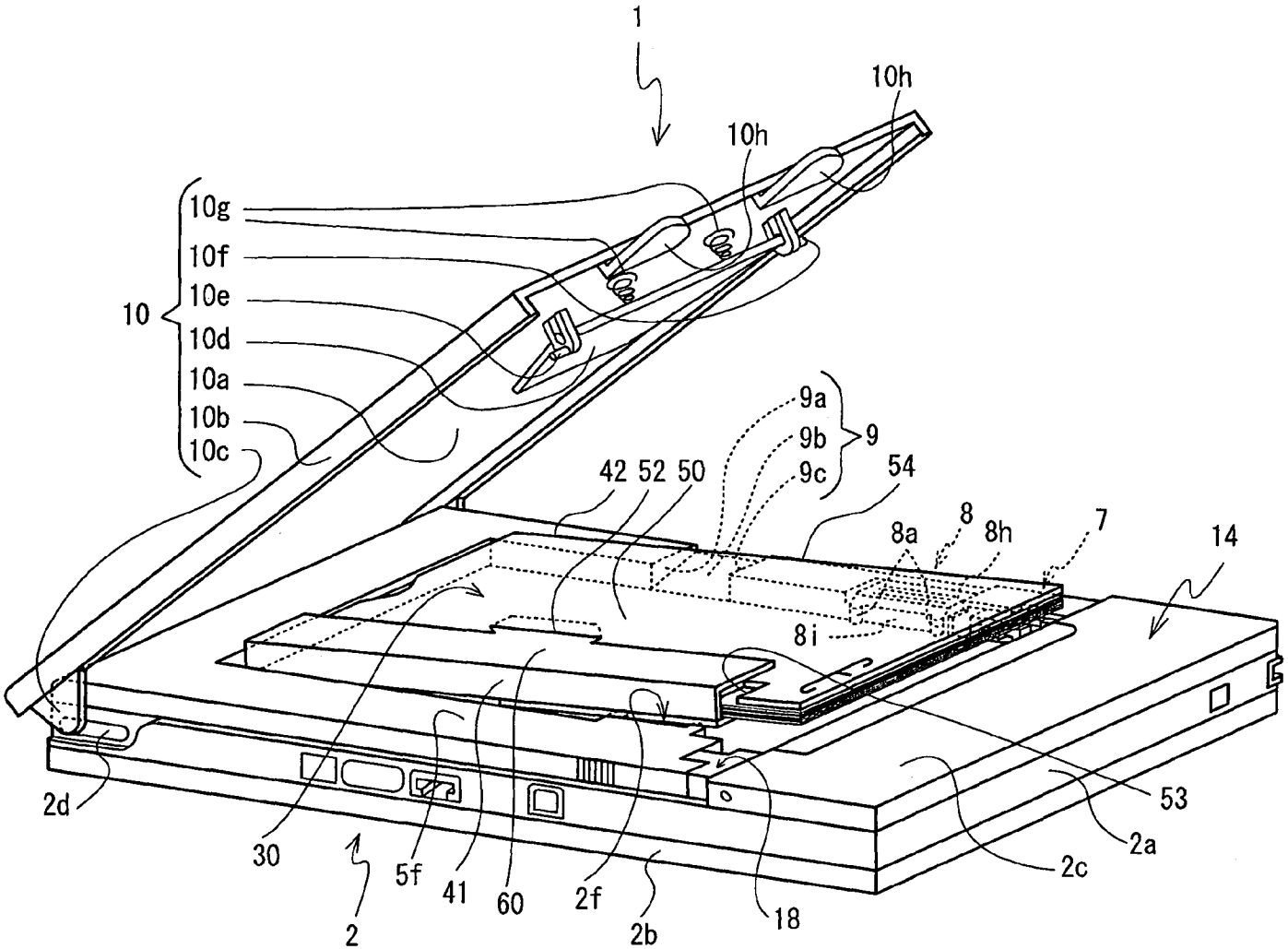
FIG. 27 is a perspective view showing a state in which the sheet package rides over a contact portion.

Next, a case where the side end portion of the side wall portion 41 side of the sheet package 30 is mounted onto the contact member 2*f* when the sheet package 30 is loaded on the storage portion 5 will be described with reference to FIG. 27. When the sheet package 30 is loaded on the storage portion 5, sometimes the side end portion on the side wall portion 41 side of the sheet package 30 may be mounted on the contact member 2*f* as shown in FIG. 27 if a user has been in a hurry to load the sheet package 30. In this case, the degree of stiffness of the side end portion on the side wall portion 41 side of the sheet package 30 is greater than the degree of stiffness of the side end portion on the side wall portion 42 side because no cut-in portion 54 is provided on the side wall portion 41 side of the sheet package 30, and because the second sheath portion 60 is folded over the first sheath portion 50. Thus, although when the lid body 10 is closed in this condition, the first sheath portion 50 and the second sheath portion 60 of the sheet package 30 are pressed by the pressing plate 10*d*, the side end portion on the side wall portion 41 side of the sheet package 30 is never crushed. Accordingly, a pressing force of the pressing plate 10*d* of the lid body 10 is applied to the side end portion on the side wall portion 41 side of the sheet package 30 and then, the sheet package 30 is pushed into the storage portion 5 in such a way that it is loaded at a correct position in the storage portion 5 as shown in FIGS. 5 and 6. Thus, as shown in FIG. 5, the reflection type optical sensor 80 provided on the printing unit 1 opposes the cutout portion 53 provided on the first sheath portion 50 of the sheet package 30 properly. Therefore, if a sheet 32 is present in the sheet package 30, the reflection type optical sensor 80 will detect a reflection light from the sheet 32. If, on the contrary, no sheet 32 is present, a reflection light from a synthetic resin which constitutes the rear face of the lid body 10 will be detected.

As described above, in the sheet package 30 of this embodiment, the degree of stiffness of the side end portion on the side wall portion 41 side that is side in contact with the contact member 2*f* of the storage portion 5 of the printing unit 1 is greater than the degree of stiffness of the side end portion on the side wall portion 42 side that is pressed by the pressing guide member 8. Thus, when the sheet package 30 is stored in the storage portion 5, even if the lid body 10 is closed in a condition in which the sheet package 30 is not loaded properly, that is, even if the side end portion (side wall portion 41) side of the sheet package 30 is sandwiched between on the one hand the lid body 10 and on the other hand the contact member 2*f* or the top face portion 5*f* on the side provided with the contact member 2*f*, the side wall portion 41 side of the sheet package 30 is never crushed by the pressing force of the lid body 10 because the side wall portion 41 side of the sheet package 30 has both a higher degree of stiffness and a sufficiently higher degree of strength than those of the side wall portion 42 side, and the sheet package 30 is pushed into the storage portion 5 by the pressing force of the lid body 10. Because the wall face of the storage portion 5 which opposes the side end portion on the side wall portion 42 side opposite to a side provided with the cutout portion 53 of the sheet package 30 is equipped with a pressing guide member 8 which advances and retracts, when the side end portion of the side wall portion 42 side is sandwiched by the lid body 10 and the pressing guide member 8, the side end portion on the side wall portion 42 side presses the pressing guide member 8 by the pressing force of the lid body 10, and in consequence the pressing guide member 8 retracts. As a result, the sheet package 30 is pushed in a correct manner into the storage portion 5 without being crushed.

Further, in the sheet package 30 of this embodiment, the bottom portion 40 (first portion) which occupies a large area and the first sheath portion 50 (second portion) are connected through a side wall portion 42 (third portion) in such a way that their respective long sides are parallel. As a result, when the package material 31 is cut out from a large sheet of paper as raw material, the number of portions that are thrown away decreases and accordingly it becomes possible to cut out a greater number of package materials.

Further, because the package material 31 which constitutes the sheet package 30 is made from a piece of single paper, the quantity of components is restricted to only one, and this merit facilitates the manufacture of the package material 31 and also serves to reduce the costs of manufacture.

The present disclosure is not restricted to the above-described embodiments but may be modified in various ways. The forward side (side wall portion 41 side) of the sheet package 30 in FIG. 27 has a higher degree of stiffness. However, if the contact member 2*f* is provided on a side of a back, the stiffness of the deep side at the back (side wall portion 41 side) is intensified. Further, although in this embodiment, the printing unit 1 is of a size hat is slightly larger than the A5 size and the sheet package 30 is of a size capable of storing the A6 size papers, they may be either larger or smaller.

Further, as the end portion on one side of the sheet package 30 which makes contact with the contact member 2*f*, rather than end portions of sheets 32 exposed outside the sheet package 30 the side wall portion 41 of the package material 31 that constitutes the sheet package 30 may be used. Alternatively, both the end portions of the sheets 32 and the side wall portion 41 may be brought into contact with the contact portion 2*f*. As the end portion on the other side of the sheet package 30 that is pressed by the pressing guide member 8, rather than end portions of sheets 32 exposed outside the sheet package 30, but the side wall portion 42 of the package material 31 that constitutes the sheet package 30 may be adopted. Alternatively, both the end portions of the sheets 32 and the side wall portion 42 may be pressed by the pressing guide member 8.

In the sheet package described above, the degree of stiffness of an end portion on one side in a width direction of a sheet package with which the contact portion of the storage portion of the printing unit makes contact is greater than the degree of stiffness of an end portion on the other side which is pressed by the pressing portion of the storage portion of the printing unit. Consequently, when the sheet package is stored in the storage portion, even if the sheet package is not loaded properly so that the side end portion of the sheet package is sandwiched between the lid and an outside portion of the storage portion on the side provided with the contact portion, even when the lid of the storage portion is closed, the sheet package is never crushed by the pressing force of the lid and thus the sheet package can be pushed properly into the storage portion.

Furthermore, the end portion on one side of the sheet package with which the contact portion makes contact may be a portion of the package material that consists the sheet package or it may be sheets exposed outside the sheet package. Further, the end portion on the other side of the sheet package pressed by the pressing portion may be either a portion of the package material that constitutes the sheet package or sheets exposed outside the sheet package.

The above-described printing unit is a printing unit to and from the sheet package can be attached or detached. When the lid is closed, the sheet package is pressed by part of the lid and an exposed portion of the sheets is pressed against the pickup roller. When the sheet package is stored in the storage portion, even if the lid of the storage portion is closed in a condition in which the sheet package is not loaded therein properly, so that the side end portion of the sheet package is sandwiched between the lid and an outside portion of the storage portion on the side provided with the contact portion, the sheet package is never crushed by the pressing force of the lid and thus, the sheet package can be pushed into the storage portion properly, because this end portion has a higher degree of stiffness than the end portion on the other side pressed by the pressing portion of the storage portion of the printing unit.

What is claimed is:

1. A sheet package for use in a printing unit, the sheet package comprising:

stacked sheets, each sheet as a printing object medium of the printing unit;

a package material that covers the outside of the stacked sheets;

the sheet package being made up in such a way as to be capable of being set in the printing unit together with the package material in such a way that part of the sheets is exposed;

two side wall portion sides being spaced in a width direction of the sheet package that is perpendicular to the direction of a sheet fed from the sheet package; wherein a degree of stiffness of end portions of the two side wall portion sides differing, for use in the printing unit, wherein the printing unit has:

a storage portion in which the sheet package is stored detachably in such a way that part of the sheets are exposed outside the sheet package in which are stored the stacked sheets;

a contact portion in the storage portion with which the end portion of one of the two side wall portion sides of the sheet package makes contact;

a pressing portion that presses the end portion of the other of the two side wall portion sides of the sheet package in such a way as to press the end portion of the one side wall portion side of the sheet package against the contact portion;

a sheet-feeding roller that feeds a sheet from the sheet package to a printing portion that prints a sheet fed from the sheet package; and a printing unit lid supported in such a way that it is capable of being opened and closed as it covers the storage portion, and a lid side pressing member for pressing an exposed portion of the sheet against the sheet-feeding roller of the printing unit at a time that the sheet package is set in the printing unit, the degree of stiffness of the end portion on the one of the two side wall portion sides that is adapted to be brought into contact with the contact portion is greater than the degree of stiffness of the end portion on the other of the two side wall portion sides that is adapted to be pressed by the pressing portion; and the sheet package further comprising:

a first portion that is rectangular, and that covers a face on one side in a stacking direction of the stacked sheets;

a second portion that opposes the first portion, and that covers a face on the other side in the stacking direction of the stacked sheets;

a third portion that is connected to the first portion and to the second portion so as to cover the side face of the sheets stacked in parallel to a sheet conveyance direction, such that the third portion constitutes the other of the two side wall portion sides;

a fourth portion that is opposite to the third portion across the stacked sheets and which covers the side face of the sheets stacked in parallel to the sheet conveyance direction, such that the fourth portion constitutes the one of the two side wall portion sides;

a fifth portion that is connected to one of the first portion and the second portion, and that covers the side face of the stacked sheets on an upstream side in the sheet conveyance direction;

a package cut-in portion provided along a border between (a) one of the first portion and the second portion and (b) the third portion to a predetermined length along the end portion of the third portion, such that the one of the first and second portions can be pressed by the printing unit lid side pressing member so as to press the exposed portion of the sheet against the sheet-feeding roller of the printing unit at the time that the sheet package is set in the printing unit, and the third portion is adapted to be pressed by the pressing portion in such a way that the fourth portion is pressed against the contact portion.

2. The sheep package according to claim 1 wherein the package material that constitutes the sheet package is made of a single piece of paper.

3. The sheet package according to claim 2, further comprising;

a sixth portion that is extended from the fourth portion, and that opposes the first portion, an engagement slit that is provided in the second portion; and an insert portion that projects from an end portion of the sixth portion, and that can be inserted into the engagement slit.

4. The sheet package according to claim 3 further comprising;

a package lid portion that covers the exposed sheets by being bent to one side and that exposes part of the sheets from the package material when it is folded back to the other side, the package lid portion being provided at an end portion of the first portion that is opposite to the fifth portion.

5. The sheet package according to claim 4 wherein package cut-in portions are formed on a border between the first portion and the package lid portion.

6. The sheet package according to claim 2, further comprising;

a package lid portion that covers the exposed sheets by being bent to one side and that exposes part of the sheets from the package material when it is folded back to the other side, the package lid portion being provided at an end portion of the first portion that is opposite to the fifth portion.

7. The sheet package according to claim 6 wherein package cut-in portions are formed on a border between the first portion and the package lid portion.

8. The sheet package according to claim 1, further comprising;

a sixth portion that is extended from the fourth portion, and that opposes the first portion, an engagement slit that is provided in the second portion; and an insert portion that projects from an end portion of the sixth portion, and that can be inserted into the engagement slit.

9. The sheet package according to claim 8 further comprising;

a package lid portion that covers the exposed sheets by being bent to one side and that exposes part of the sheets from the package material when it is folded back to the other side, the package lid portion being provided at an end portion of the first portion that is opposite to the fifth portion.

10. The sheet package according to claim 9 wherein package cut-in portions are formed on a border between the first portion and the package lid portion.

11. The sheet package according to claim 1 further comprising;

a package lid portion that covers the exposed sheets by being bent to one side and that exposes part of the sheets from the package material when it is folded back to the other side, the package lid portion being provided at an end portion of the first portion that is opposite to the fifth portion.

12. The sheet package according to claim 11 wherein package cut-in portions are formed on a border between the first portion and the package lid portion.

13. A printing unit onto which the sheet package according to claim 1 can be detachably loaded, the printing unit comprising:

a storage portion in which the sheet package is stored detachably in such a way that part of the sheets are exposed outside the sheet package in which are stored the stacked sheets;

a contact portion in the storage portion with which an end portion of one of the two side wall portion sides of the sheet package makes contact;

a pressing portion that presses an end portion of the other of the two side wall portion sides of the sheet package in such a way as to press the end portion of the one side wall portion side of the sheet package against the contact portion;

a sheet-feeding roller that feeds a sheet from the sheet package to a printing portion that prints a sheet fed from the sheet package; and a printing unit lid supported in such a way that it is capable of being opened/closed as it covers the storage portion, and a lid side pressing member for pressing an exposed portion of the sheet against the sheet-feeding roller of the printing unit at a time that the sheet package is set in the printing unit;

wherein the sheet-feeding roller that feeds a sheet from the sheet package is provided in the storage portion and by the printing unit lid being closed, the sheet package is pressed by part of the printing unit lid, and an exposed portion of the sheet is accordingly pressed against the sheet-feeding roller.

* * * * *